US006271450B1

(12) United States Patent
Mackie

(10) Patent No.: US 6,271,450 B1
(45) Date of Patent: Aug. 7, 2001

(54) BEATER ARRANGEMENT

(76) Inventor: Kevin Mackie, Flat 2/1, 8 Striven Gardens, Glasgow, G20 6DZ (GB)

( * ) Notice: Subject to any disclaimer, the term of this patent is extended or adjusted under 35 U.S.C. 154(b) by 0 days.

(21) Appl. No.: 09/341,712

(22) PCT Filed: Jan. 16, 1998

(86) PCT No.: PCT/GB98/00052

§ 371 Date: Jul. 16, 1999

§ 102(e) Date: Jul. 16, 1999

(87) PCT Pub. No.: WO98/32120

PCT Pub. Date: Jul. 23, 1998

(30) Foreign Application Priority Data

Jan. 16, 1997 (GB) ..... 9700831

(51) Int. Cl.[7] ..... G10D 13/02
(52) U.S. Cl. ..... 84/422.1; 84/422.2; 84/422.3
(58) Field of Search ..... 84/422.1, 422.2, 84/422.3

(56) References Cited

U.S. PATENT DOCUMENTS

| | | | | |
|---|---|---|---|---|
| 1,369,233 | | 2/1921 | Fitzgerald et al. | 84/422.2 |
| 1,604,945 | | 10/1926 | Rohr | 84/422.1 |
| 2,484,302 | | 10/1949 | Laverents | 210/254 |
| 3,677,128 | * | 7/1972 | Simpson | 84/422.1 |
| 3,750,517 | | 8/1973 | Sleishman | 84/422.1 |
| 3,988,957 | * | 11/1976 | Escamilla | 84/422.1 |
| 4,188,853 | * | 2/1980 | Bills | 84/422.1 |
| 4,381,690 | * | 5/1983 | Kimble | 84/422.3 |
| 5,591,929 | * | 1/1997 | Wellman | 84/422.1 |
| 5,883,321 | * | 3/1999 | Hsieh | 84/422.3 |
| 5,990,401 | * | 11/1999 | Braun et al. | 84/422.1 |
| 6,002,076 | * | 12/1999 | Karn | 84/422.1 |

FOREIGN PATENT DOCUMENTS

| | | |
|---|---|---|
| 89 14 283 | 3/1990 | (DE) . |
| 207 278 | 6/1988 | (GB) . |
| 238 154 | 5/1991 | (GB) . |

* cited by examiner

*Primary Examiner*—Shih-Yung Hsieh
(74) *Attorney, Agent, or Firm*—Ratner & Prestia

(57) ABSTRACT

A beater pedal arrangement for use with a drum, particularly a bass drum, wherein the beater pedal arrangement includes first and second drum beaters which are designed to strike the same drum. During depression of a play pedal of the arrangement by the user, the first beater travels on an arc towards the drum and strides the drum surface and the second beater travels on an arc away from the drum. The second beater is biased by return springs which force the second bearer to travel on an arc towards the drum to strike the drum surface when the user releases the play pedal.

The beater pedal arrangement also includes a beater disactivating arrangement which enables the user to disactivate one of the drum beaters, particularly the second drum beater, by restraining the beater at a point along its striking arc, such that drum surface may be struck utilising one drum beater. The beater disactivating arrangement includes an activating lever and a disactivating lever in a preferred embodiment, the levers acting to activate and disactivate the disactivating arrangement by the user depressing the required pedal.

The preferred embodiments of the invention further include shock absorbing means to prevent double-striking by the first beater induced by movement of the second beater.

40 Claims, 23 Drawing Sheets

134
135
132
133
131
137
138
136
139

1

BEATER ARRANGEMENT

FIELD OF THE INVENTION

This invention relates to a double acting beater arrangement particularly, but not exclusively, for a bass drum.

SUMMARY OF THE INVENTION

According to a first aspect, the present invention provides a beater pedal arrangement, comprising a first and a second beater each arranged to follow a respective striking arc in which the arrangement is also provided with a disactivating means operable by a user to prevent at least one of the beaters from striking by retaining that beater at a position along its striking arc.

BRIEF DESCRIPTION OF THE DRAWINGS

Each beater may be arranged to impact a drum skin of, for example, a bass drum when it follows its striking arc; the beaters may be arranged to impact the same drum skin.

The beaters may be arranged such that:

Figure 1:
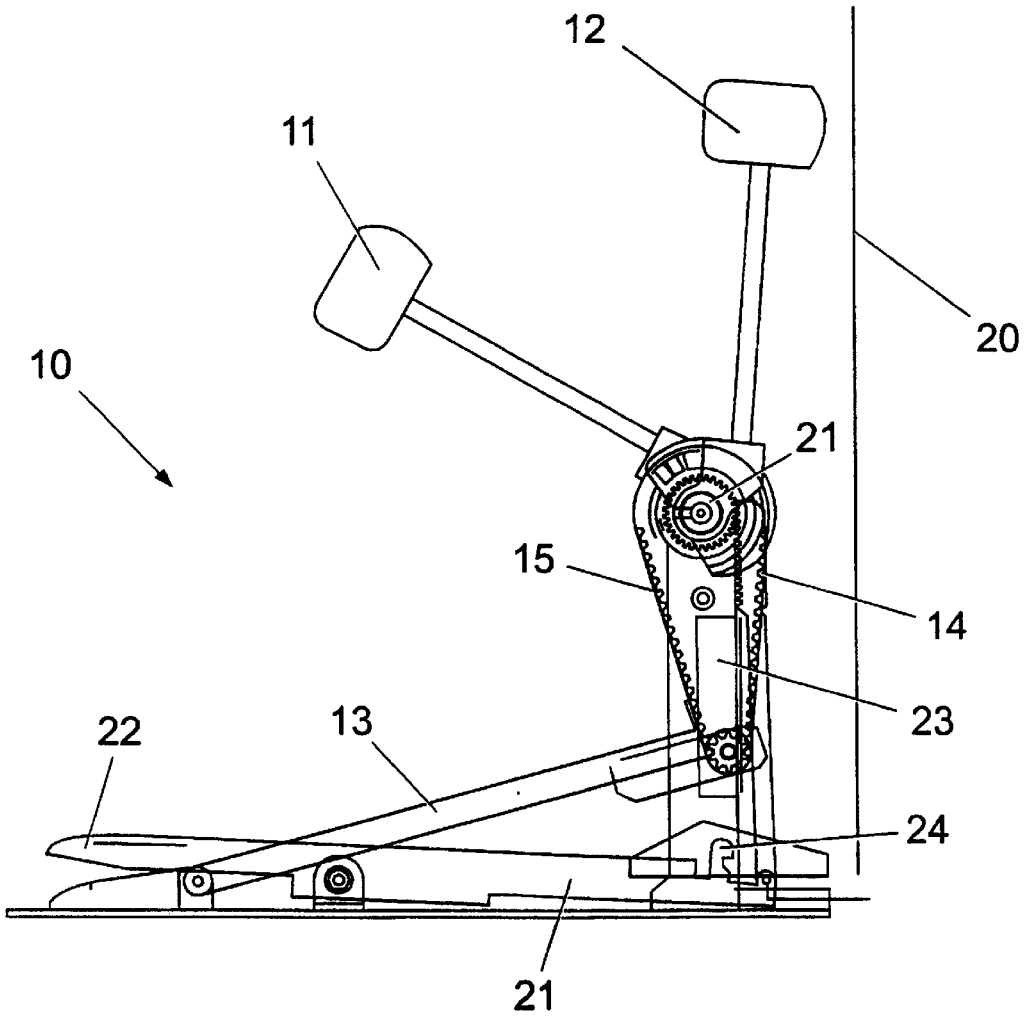

a. upon the beater pedal being moved in a first direction, the first beater is moved along its striking arc to strike a drum skin whilst the second beater is moved along its striking arc away from the drum skin; and b. upon the beater pedal being moved in a second direction, the second beater is moved along its striking arc to strike a drum skin whilst the first beater is moved along its striking arc away from the drum skin.

Each beater may be moved by the beater pedal by drive means which may take the form of a belt, a cord, a chain, a gear or a linkage.

The or at least one of the beaters may have a spring return. At least one of the beaters may be strikable against the drum skin by means of its spring return.

The disactivating means is preferably operable by the user whilst playing, for example, a drum using the beater arrangement. It may be foot activated; it may be heel activated and is preferably activated by being pressed downwardly. The disactivating means may have a click on/off arrangement such that it is engaged by being depressed once and disengaged by being pressed once. It may be pressed in the same direction for both engaging and disengaging; in this form, it may be similar to the arrangement for a retractable ballpoint pen.

The disactivating means may be electrically, hydraulically, pneumatically or mechanically operated.

According to a second aspect, the present invention provides a beater pedal arrangement comprising a first and a second beater each arranged to follow a respective striking arc in which the arrangement comprises a disactivating means operable by a user to disactivate at least one of the beaters, and in which the disactivating means is alternatively engageable and disengageable by being depressed through a single line of action.

According to a third aspect, the present invention provides a beater pedal arrangement comprising at least one beater arranged to follow a striking arc in which the arrangement has opposing first and second resilient means which together act to bias the beater towards a neutral position along its striking arc.

One or each of the resilient means may be provided by a spring.

The beater may have an associated arm arranged to pivot so as to permit rotation of the beater along its striking arc. The opposing resilient means may be arranged on respective first and second sides of the pivot point of the arm.

The opposing resilient means may facilitate return of the beater to its neutral position. The arrangement may smooth the beat of the beater and reduce "waggle" of the beater.

According to a fourth aspect, the present invention provides a beater pedal arrangement having a first beater arranged to follow a first striking arc about a first axis of rotation and a second beater arranged to follow a second striking arc about a second axis of rotation in which the first and second axes of rotation are inclined.

The beaters may be arranged to strike, for example, a drum skin in adjacent positions. Alternatively, the beaters may be arranged to strike a drum skin in the same or substantially the same position.

This arrangement may enable each of the beaters to hit the sweet spot of the drum.

According to a fifth aspect, the present invention provides a beater pedal arrangement comprising a first and a second beater in which the beater pedal has a split foot board, a first portion of the foot board being arranged to play the first beater and the second portion of the foot board being arranged to play the second beater.

The beaters may be playable independently. The beater pedal arrangement may have disactivation means to disactivate at least one of the beaters and/or at least one of the portions of the foot board.

The first and second beaters are preferably playable together, at the option of the user, by the user simultaneously operating the first and second portions of the foot board with his or her foot.

The foot board may be split such that it has a left hand portion and a right hand portion. The right hand portion may be arranged to play the right hand beater and the left hand portion may be arranged to play the left hand beater.

According to a sixth aspect, the present invention provides a beater pedal arrangement having a first and a second beater and comprising a compensation means arranged such that the sound produced by each of the beaters is substantially similar.

A problem than can occur with known double acting drum pedals, especially when a first beater is driven to strike by action of the footplate and a second beater is caused to strike by action of a return spring, is that the return beater sounds more softly than the first beater.

The compensation means may be provided by a compensation weight; this may be an additional weight associated with the second beater compared with the weight associated with the first beater. The compensation weight may be provided on the beater shaft and/or in the beater pad. The compensation weight may be an integral part of the second beater; alternatively, it may be removable and it may be adjustable.

The compensation means may be provided by arranging the second beater at a height above the first beater; this may increase the impact momentum of the second beater by increasing its striking arc.

The height of at least one of the beaters may be adjustable, for example, by means of wing nuts.

According to a seventh aspect, the present invention provides a removable insert for a footplate of a beater pedal arrangement.

The removable insert may be adapted to be used with an existing footplate. Alternatively, the removable insert may be used as a replacement for an existing footplate.

The removable insert may be decorated.

According to an eighth aspect, the present invention provides an arrangement comprising a floor mounted drum and a floor mounted beater pedal arrangement in which the drum is arranged on a removable spacer to adjust the relative heights of the drum and the beater pedal arrangement.

This arrangement may ensure that the beater hits the drum exactly in its sweet spot.

The spacer may be height adjustable.

According to a ninth aspect, the present invention provides a spacer for use in an arrangement in accordance with the eighth aspect of the invention.

According to a further aspect, the present invention provides a beater pedal arrangement comprising an attachment means for attaching a beater pedal arrangement to a portion of a drum, in which the attachment means provides for attachment to a drum at more than one height.

The attachment means may be variable in height or a plurality of attachment means at different heights may be provided.

According to a tenth aspect, the present invention provides a beater pedal arrangement comprising a first and a second beater rotatable about a common axis of rotation in which the first beater is adapted to strike a striking surface by means of rotating in a first direction about the axis and the second beater is adapted to strike a striking surface by means of rotating in an opposite direction about the axis of rotation.

The first and second beaters may be adapted to strike the same striking surface.

The first and second beaters may be arranged substantially 180 degrees from each other about the axis rotation. The axis of rotation may be substantially horizontal.

Preferably the beater pedal arrangement has at least one disactivating means which may be operable by a user whilst playing, to disengage at least one of the beater.

The beater pedal arrangement may have a second set of beaters arranged in a similar fashion to the first set.

Figure 2:
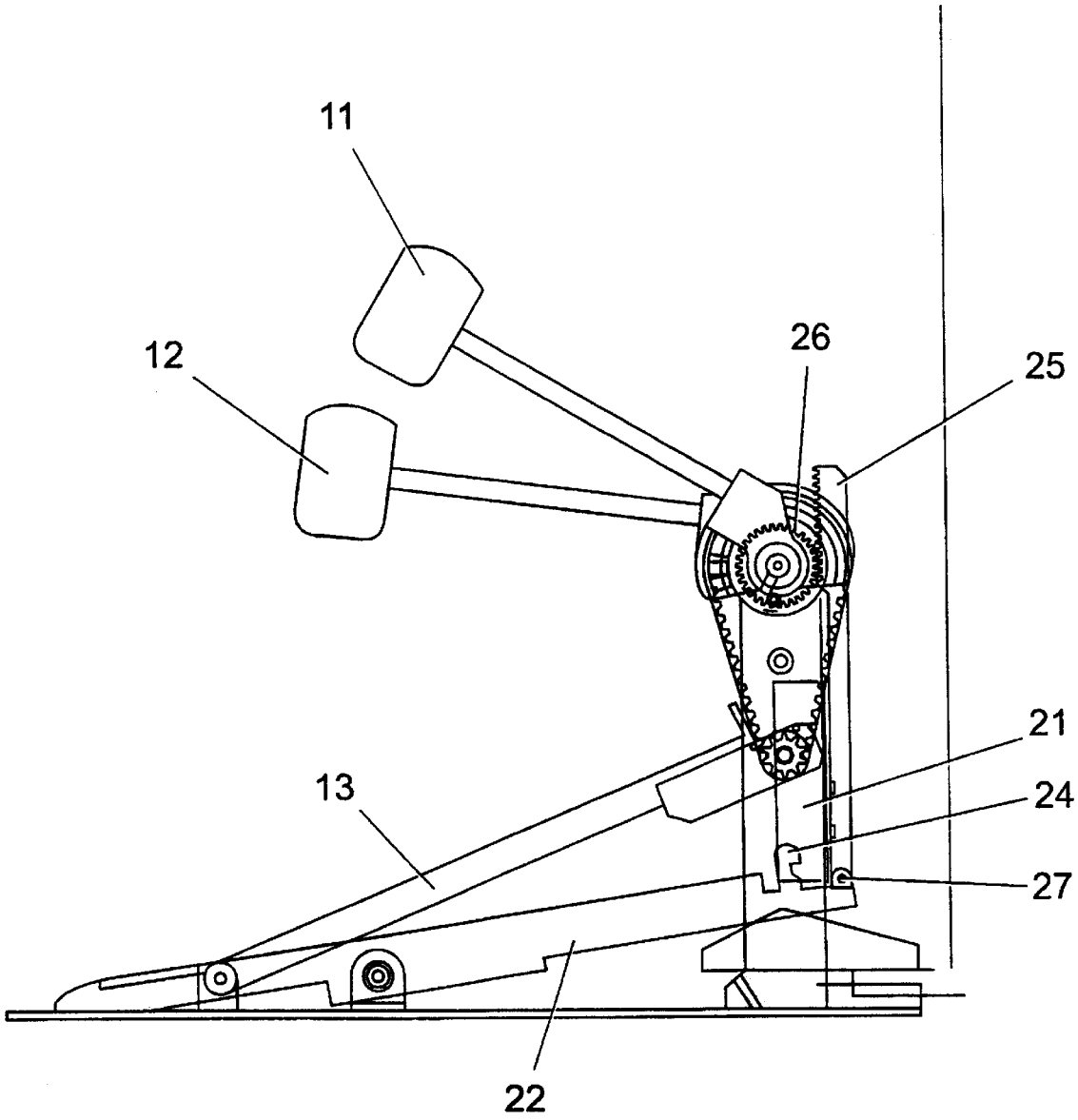
Figure 3:
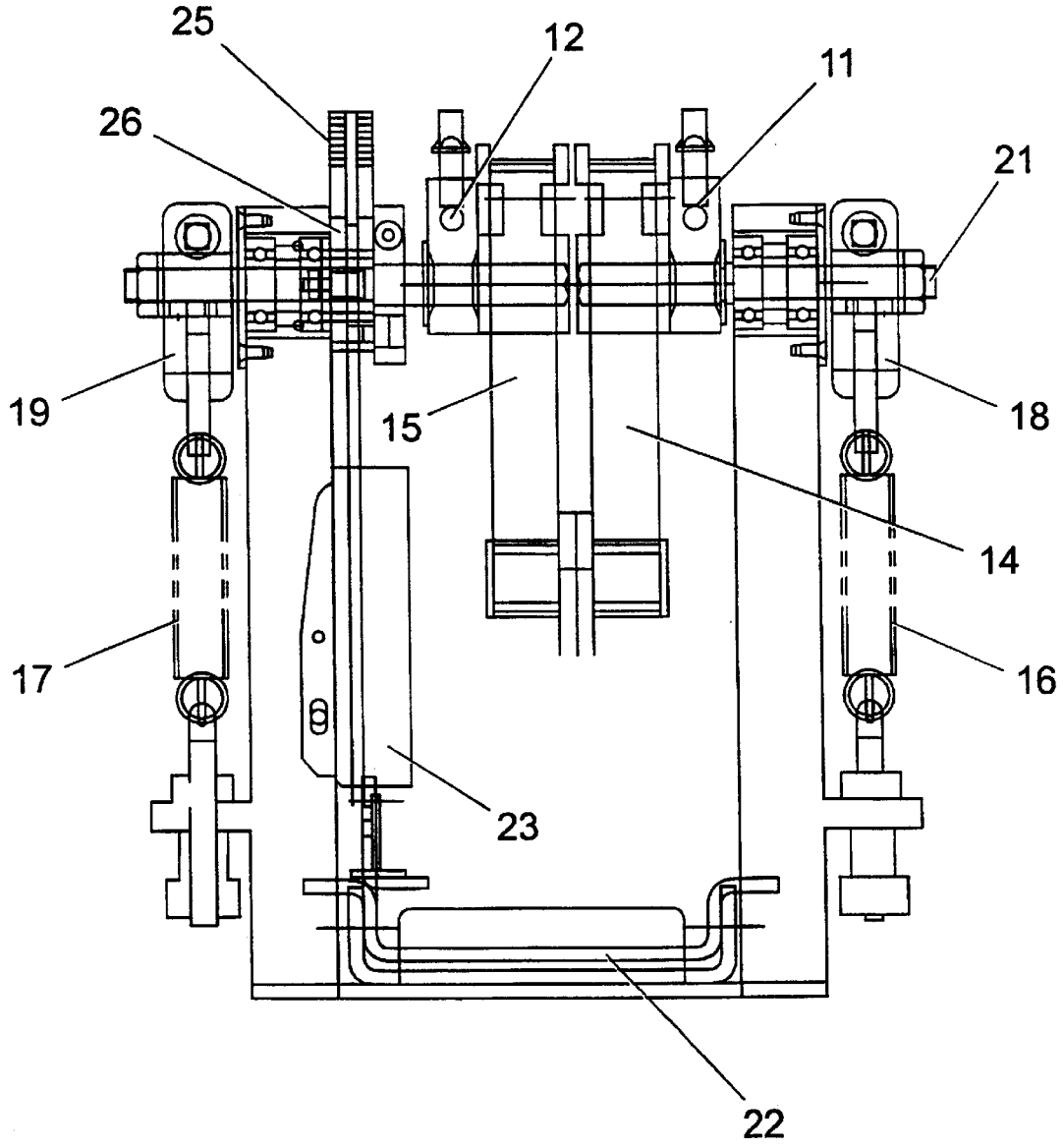
Figure 4:
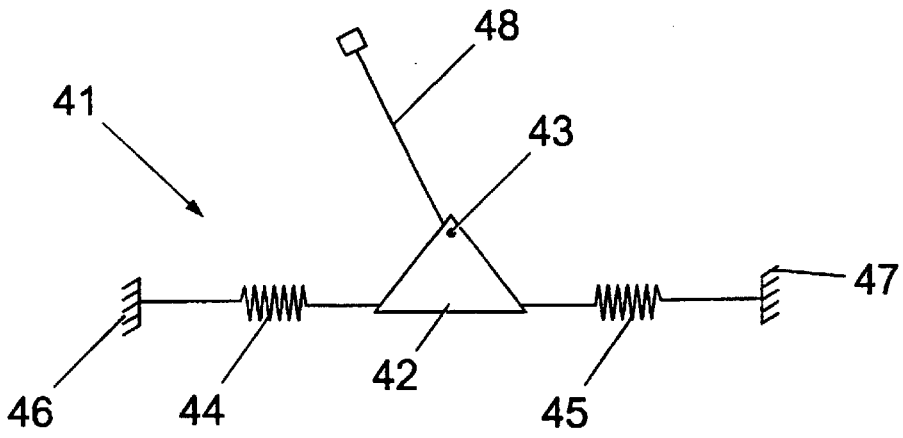
Figure 5A:
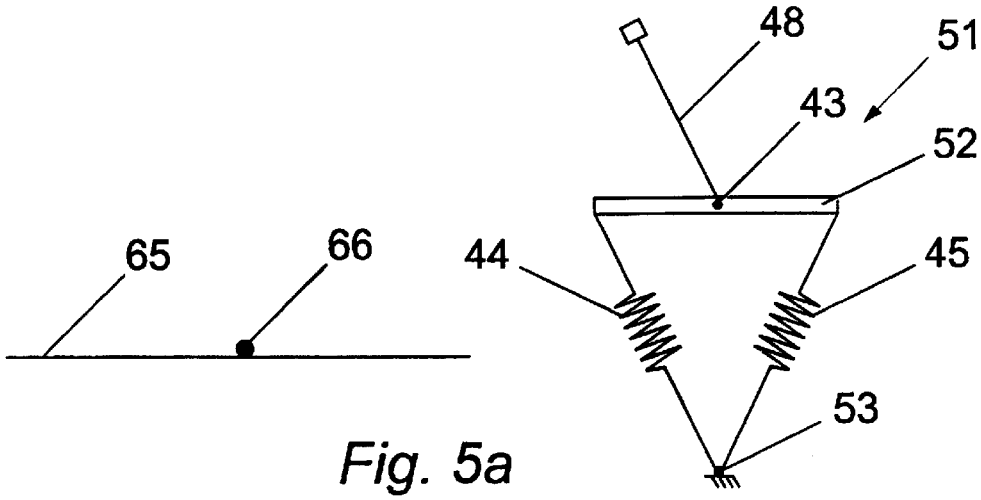
Figure 5B:
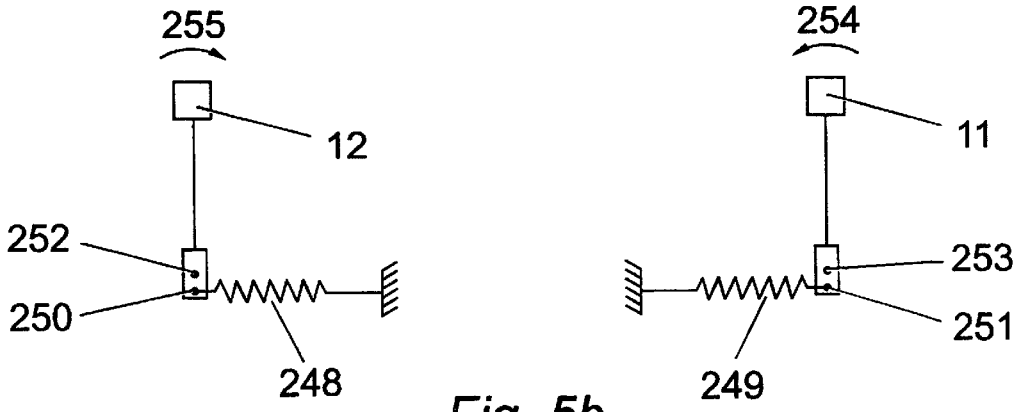
Figure 5C:
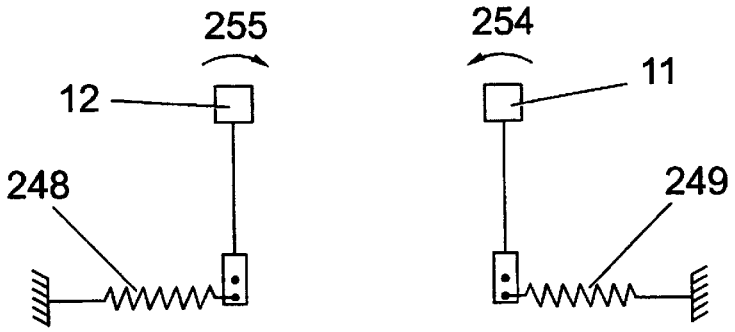
Figure 5D:
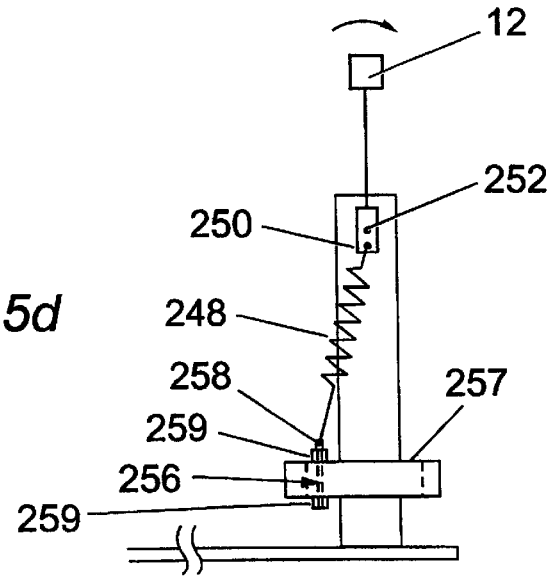

Embodiments of the present invention will now be described, by way of example only, with reference to the accompanying drawings of which:

FIG. 1 is a schematic side view of a first beater pedal arrangement in a first configuration;

FIG. 2 is a schematic side view of the first beater pedal arrangement in a second configuration;

FIG. 3 is a simplified front view of part of the first beater arrangement with the footplate removed for clarity;

FIG. 4 is a schematic side view of part of an alternative arrangement;

FIG. 5A is a schematic side view of part of another arrangement;

FIG. 5B is a schematic side view of part of another arrangement;

FIG. 5C is a schematic side view of part of another arrangement;

FIG. 5D is a schematic side view of part of a further alternative arrangement.

Figure 6:
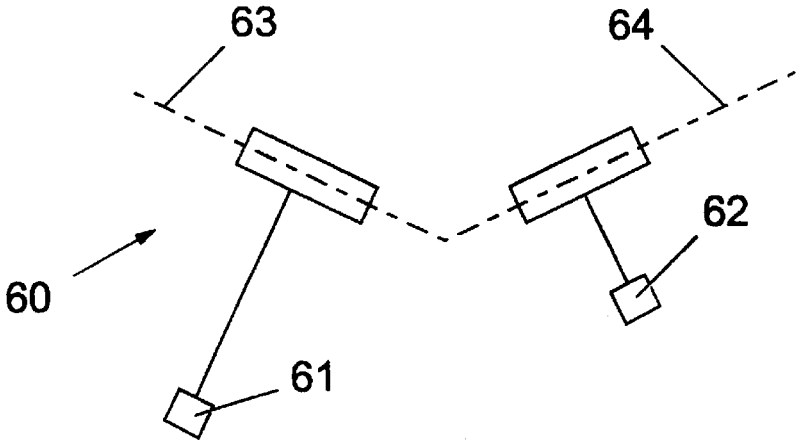

FIG. 6 is a schematic plan view of part of a further arrangement.

Figure 7:
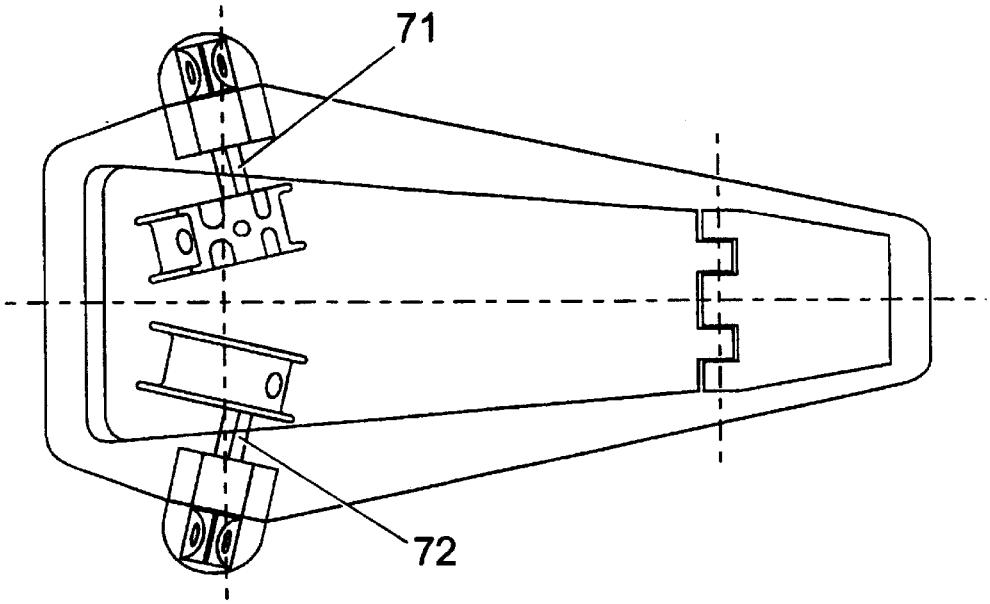
Figure 8:
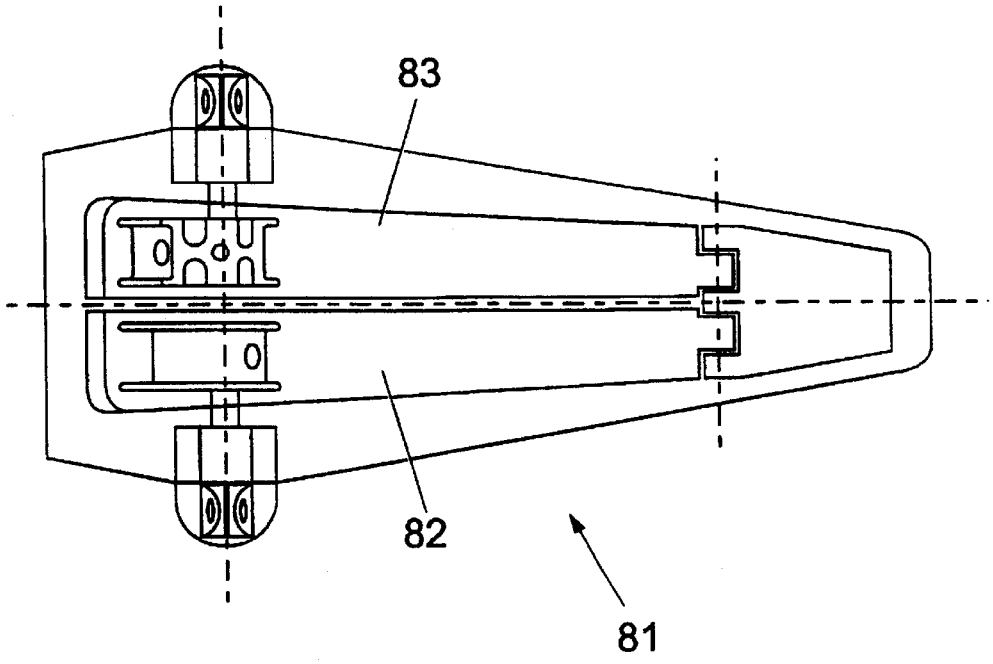
Figure 9:
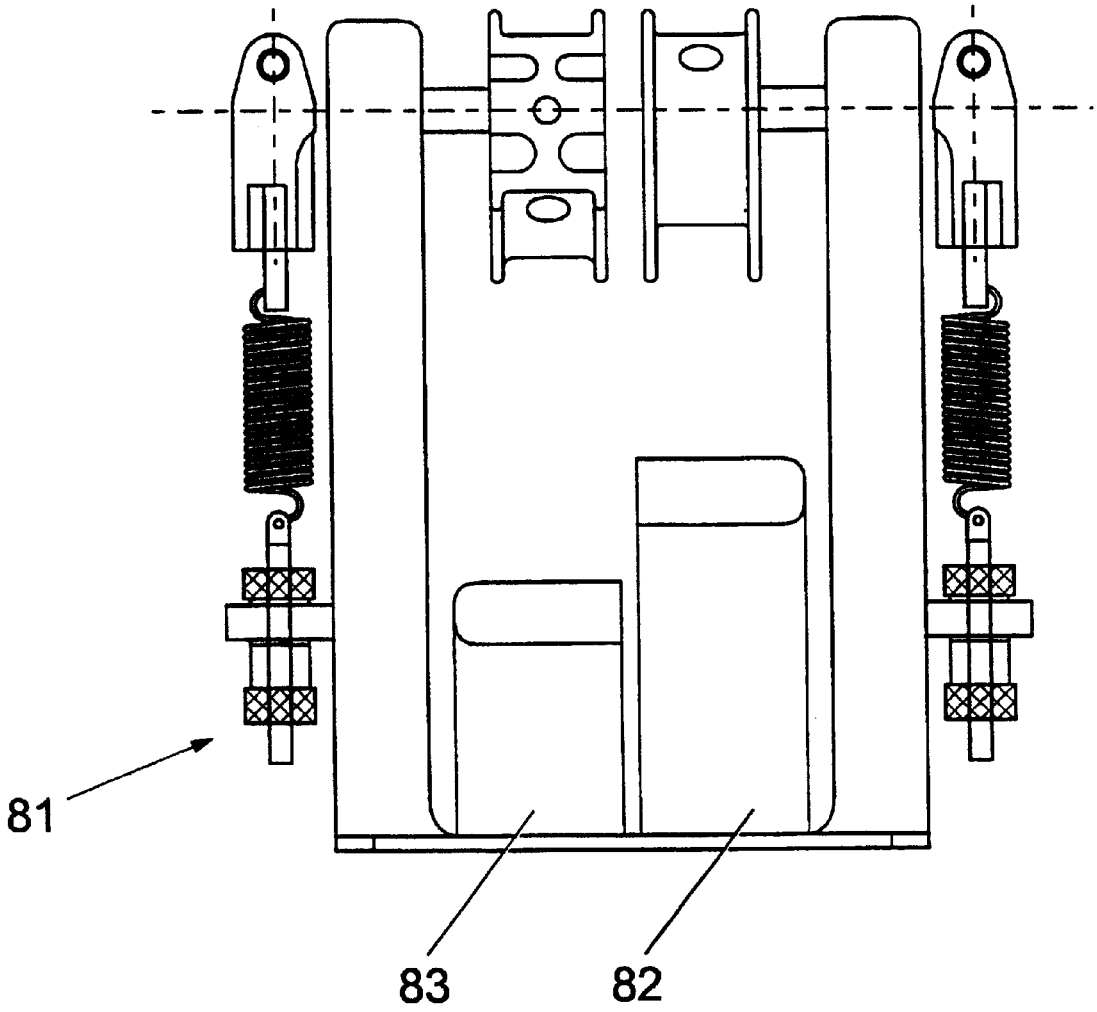
Figure 10:
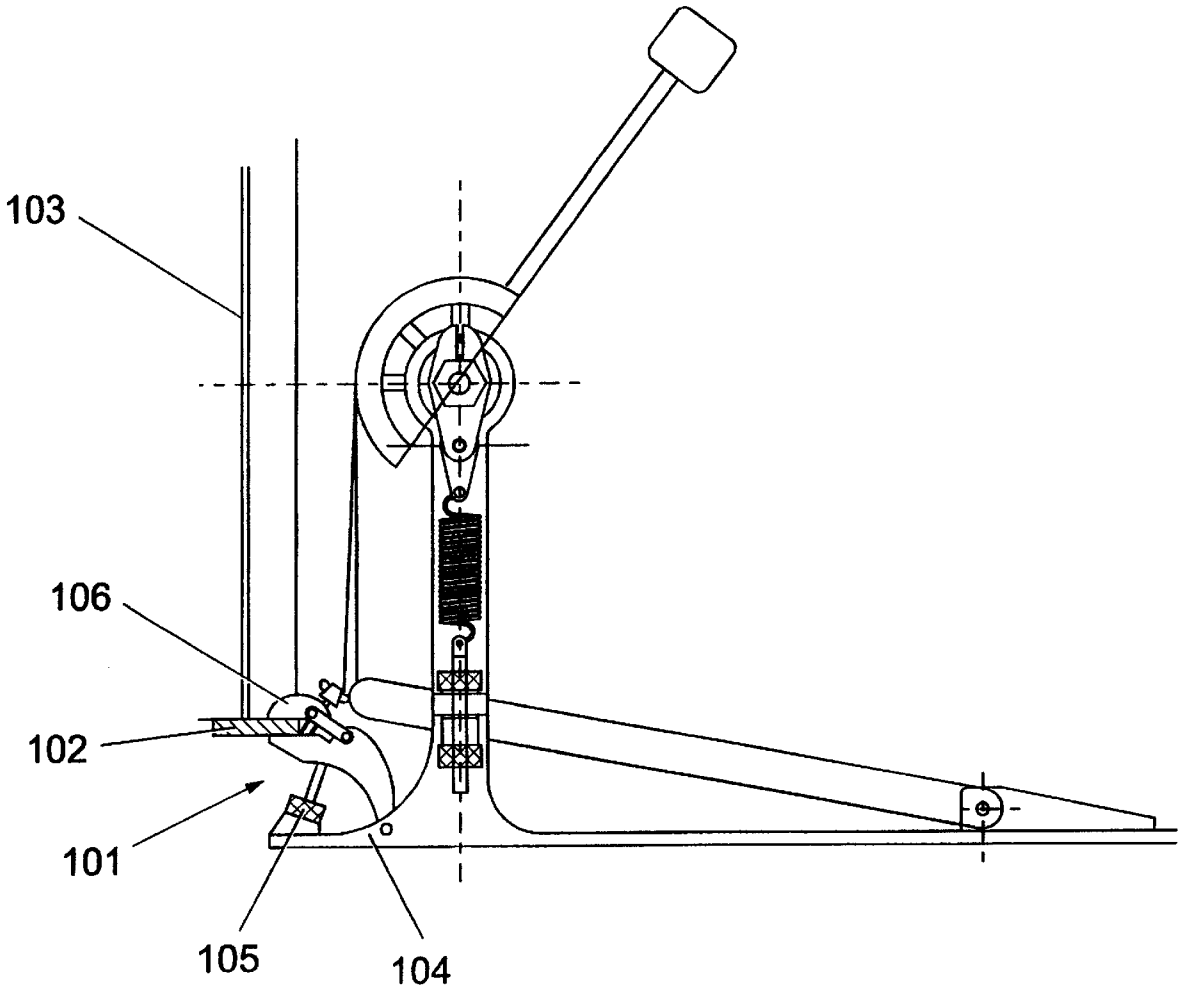
Figure 11:
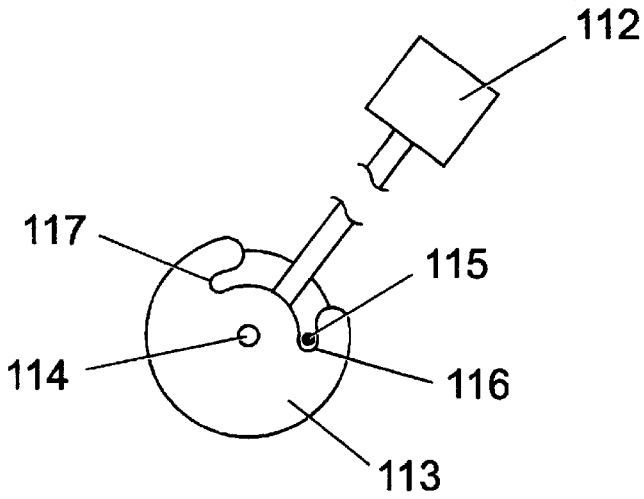
Figure 12:
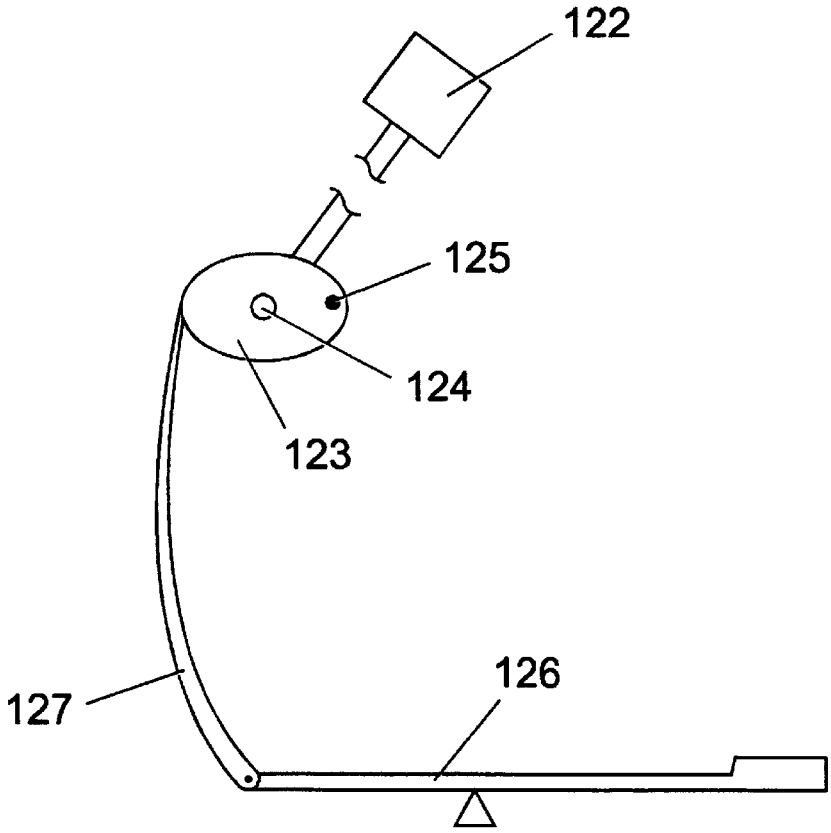
Figure 14:
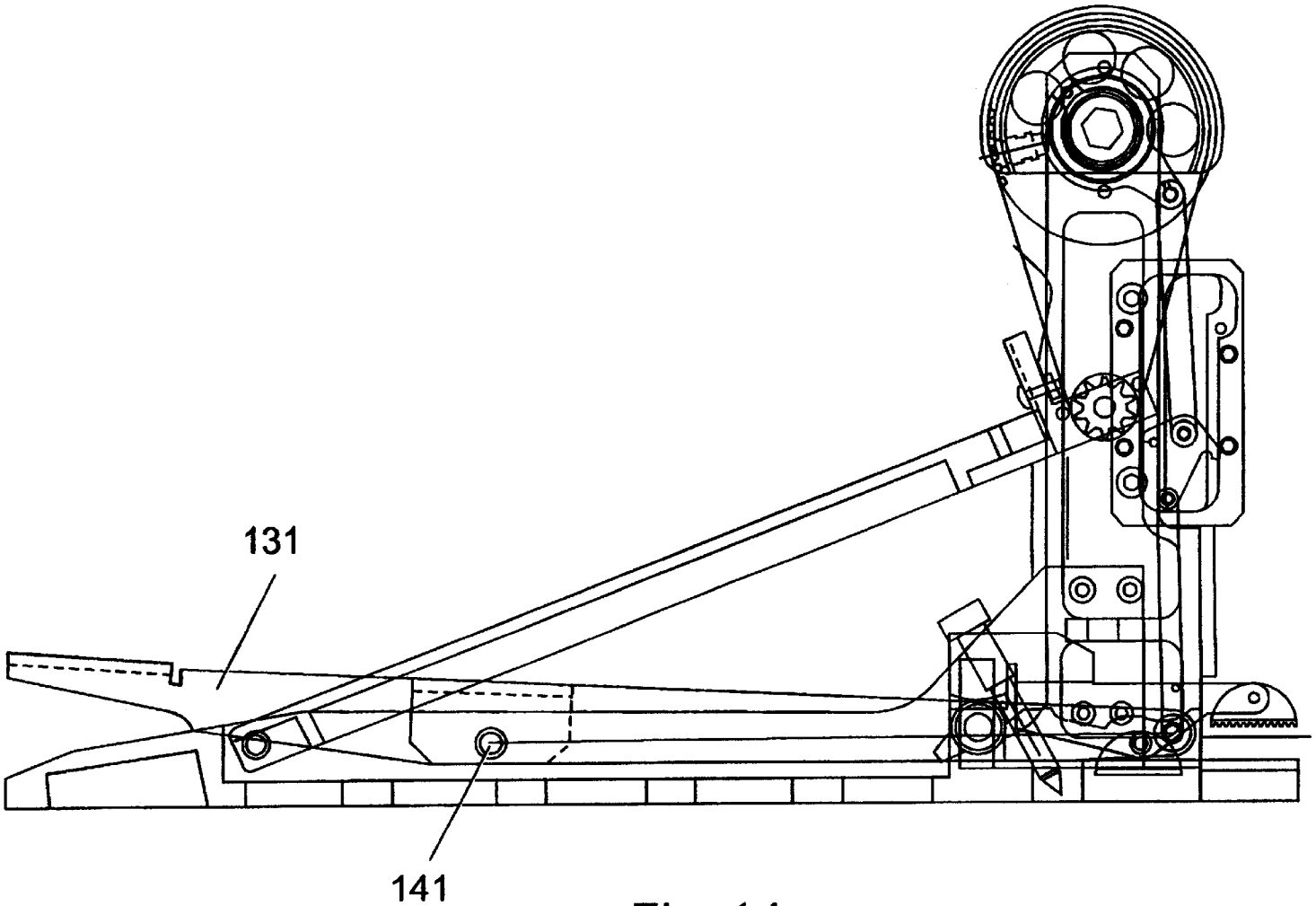
Figure 15A:
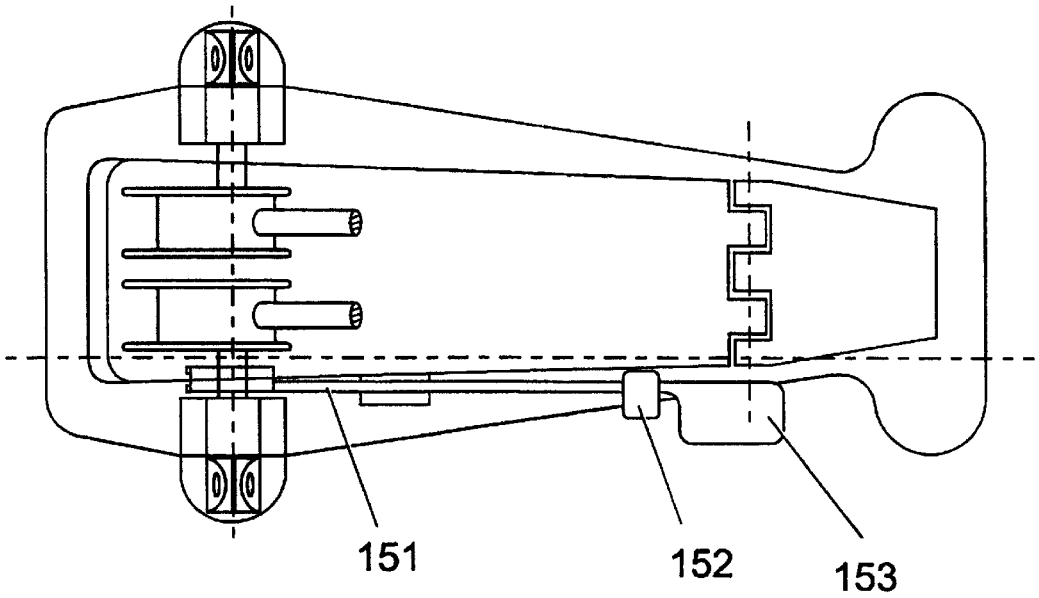
Figure 15B:
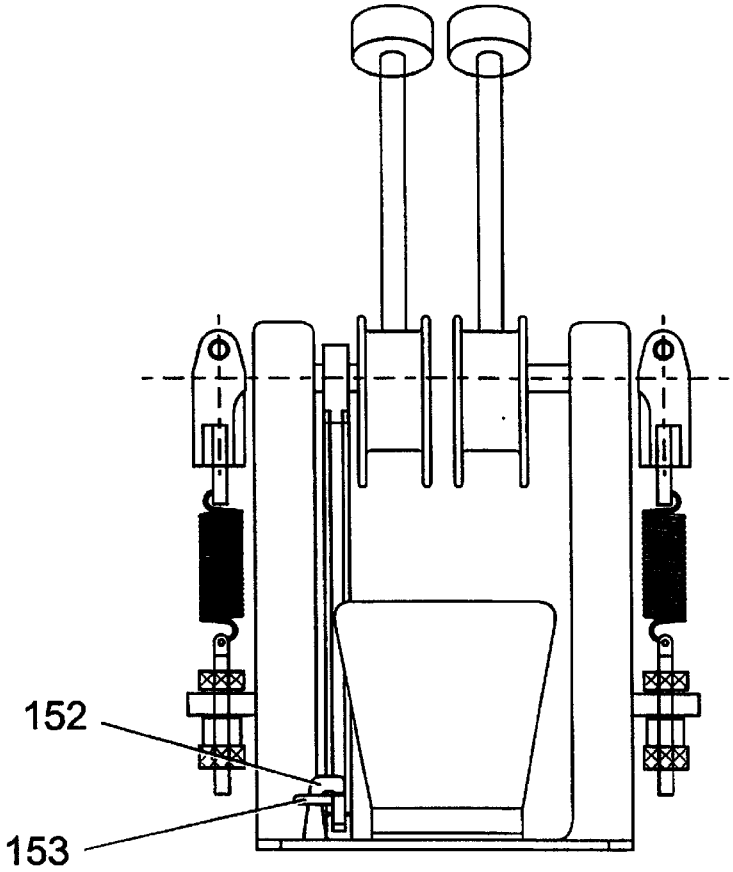
Figure 16A:
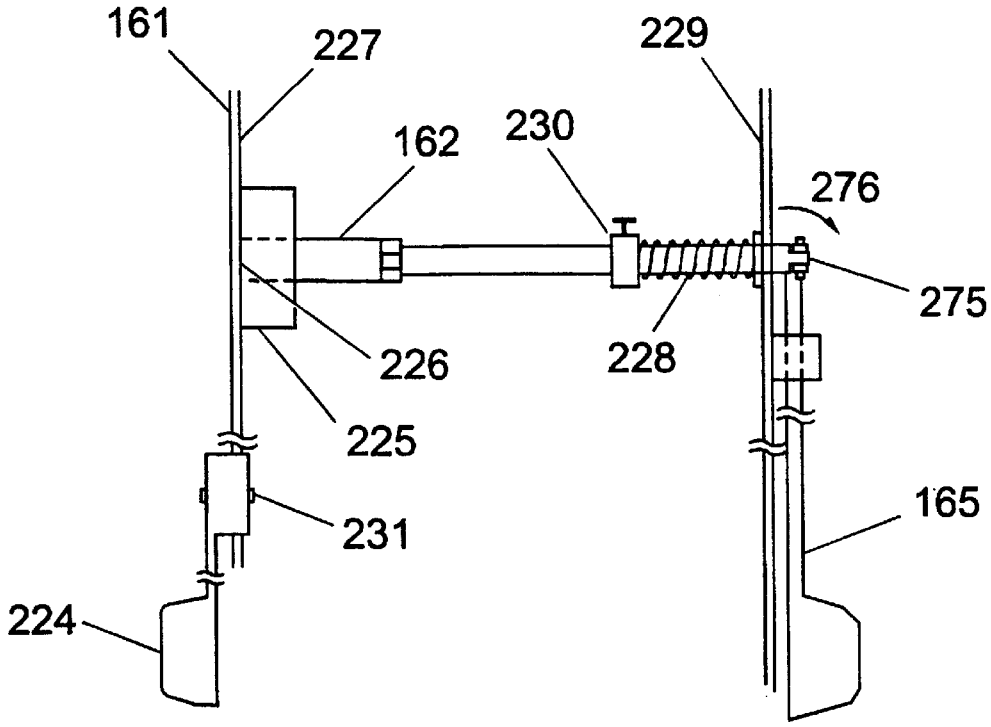
Figure 17A:
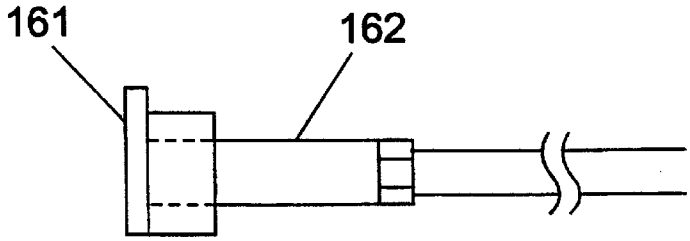
Figure 16B:
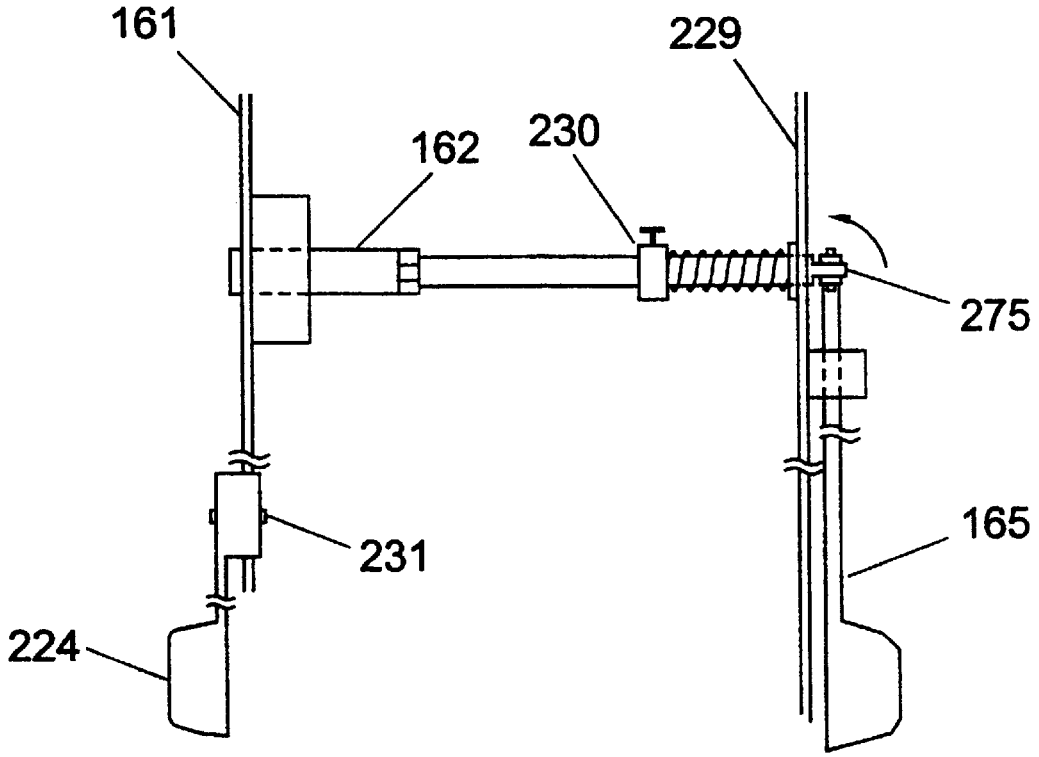
Figure 17B:
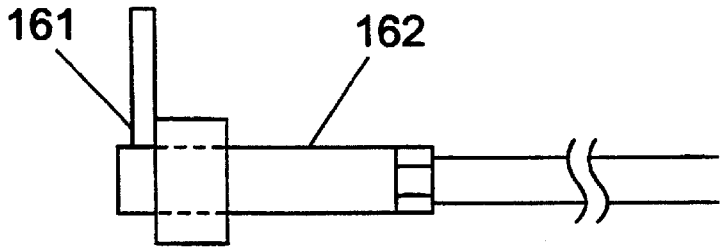
Figure 18:
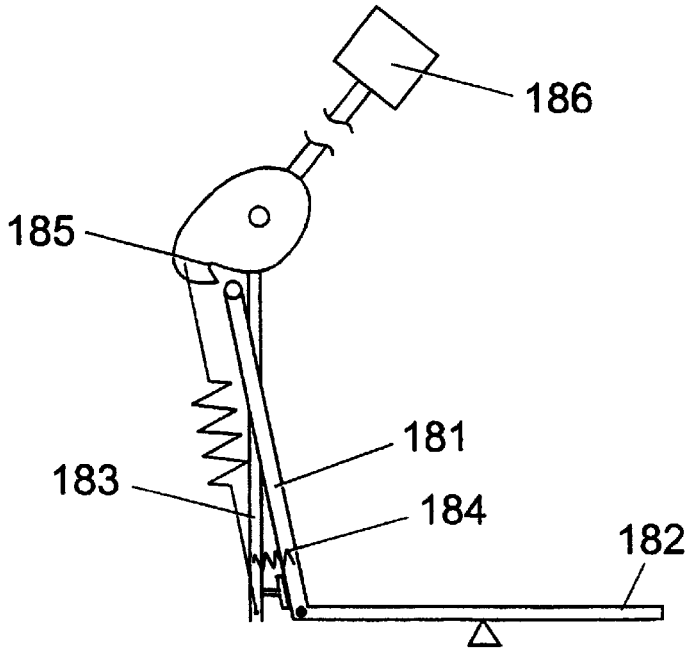
Figure 19:
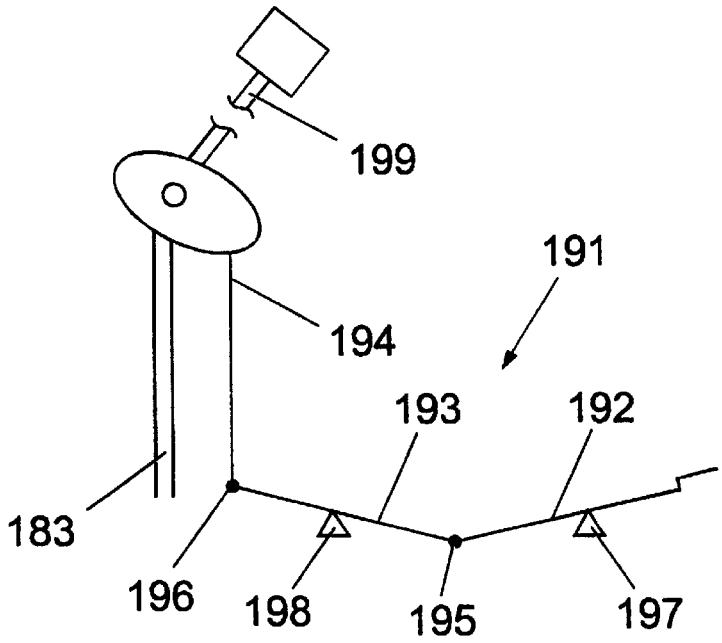
Figure 20:
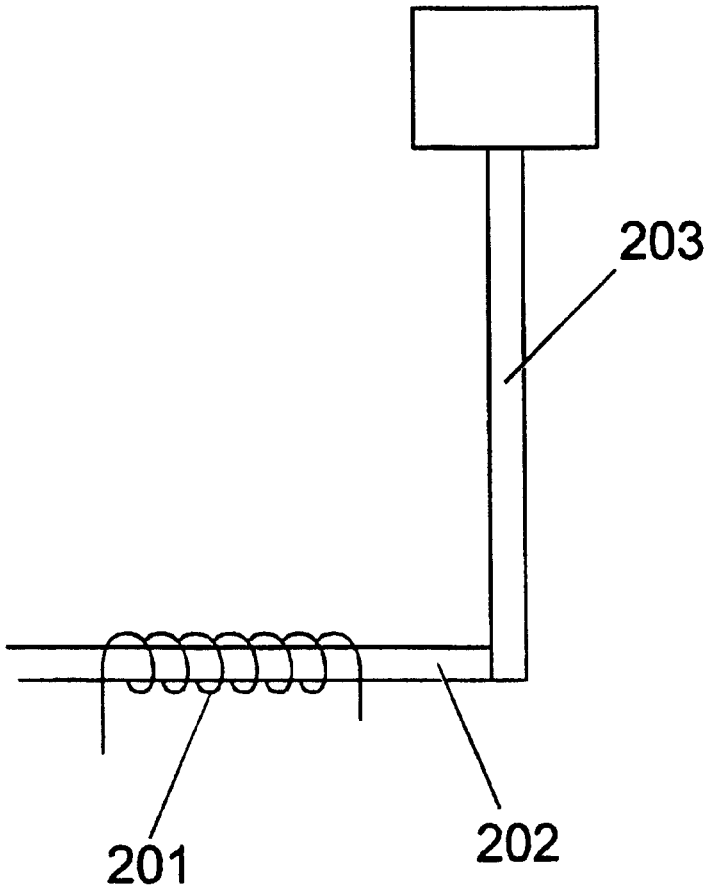
Figure 21:
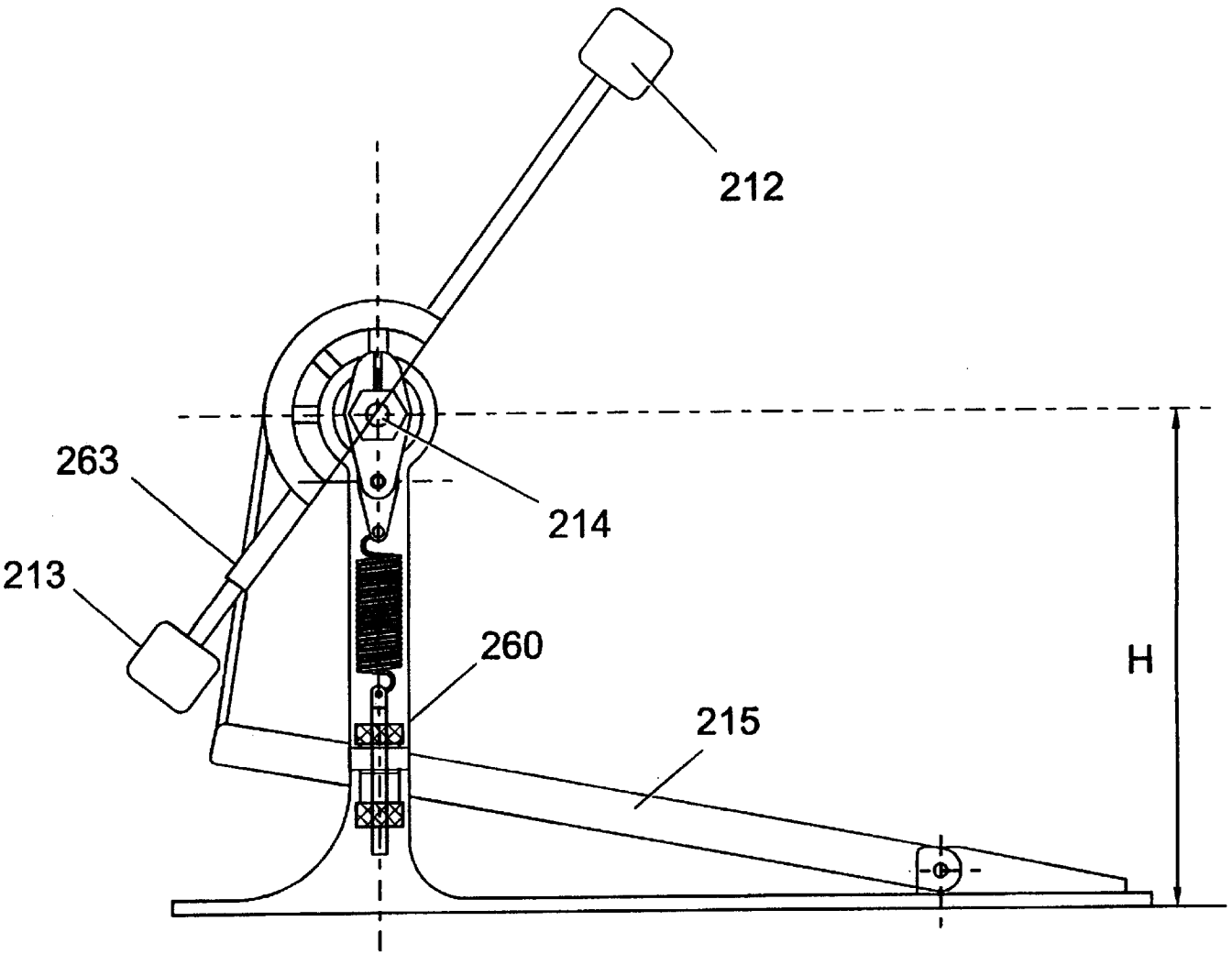
Figure 22:
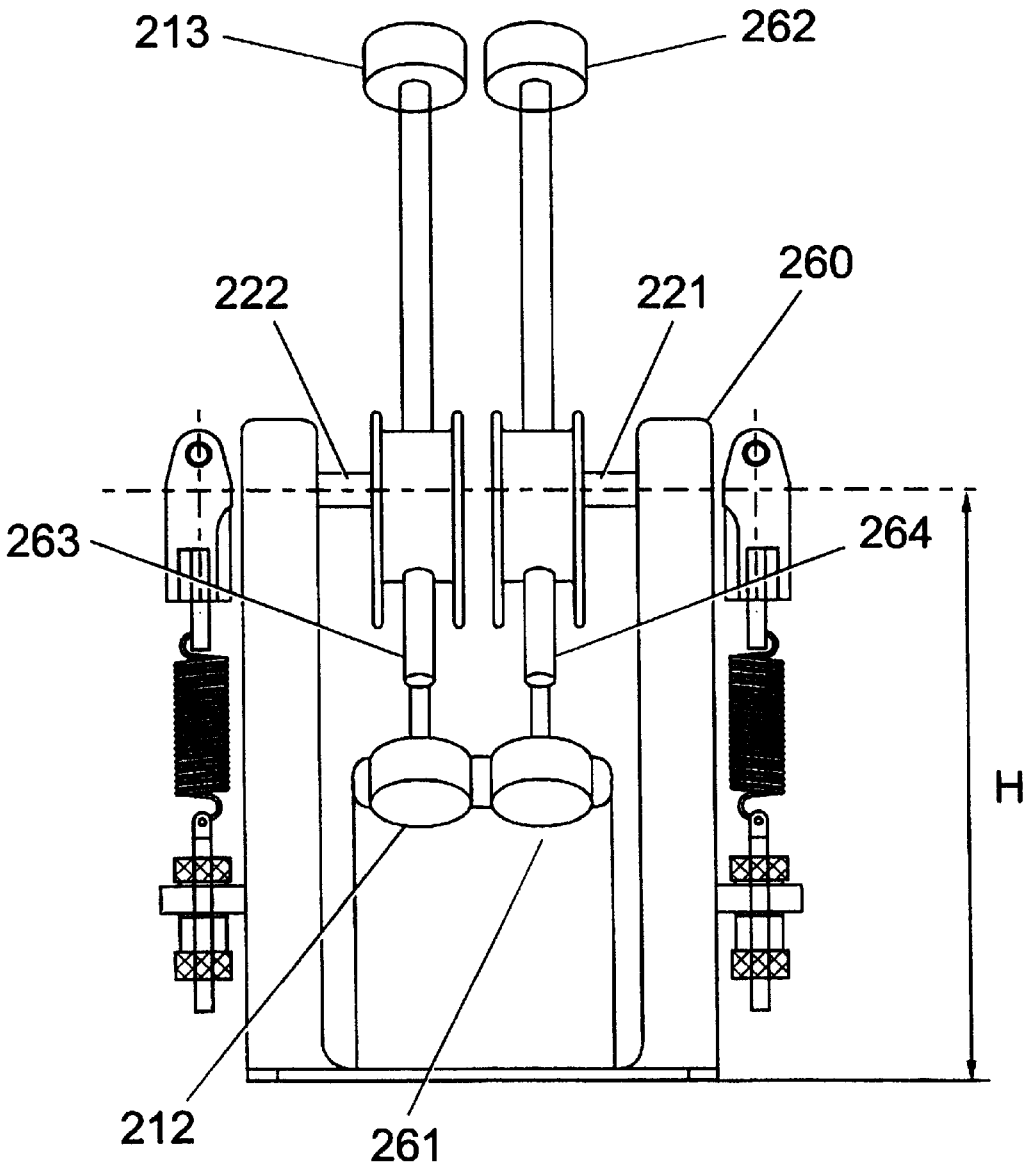
Figure 23A:
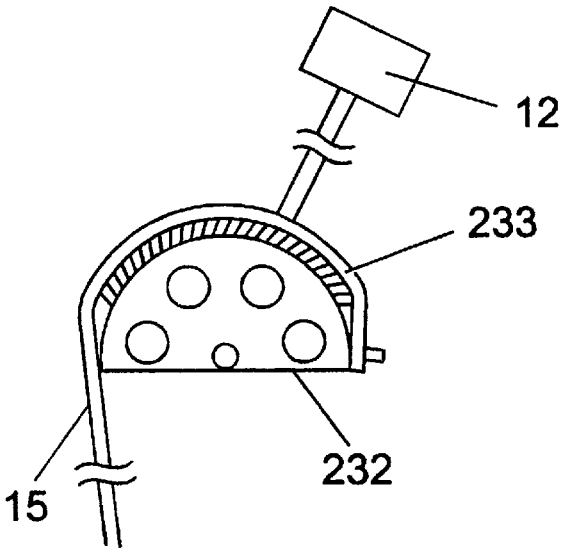
Figure 23B:
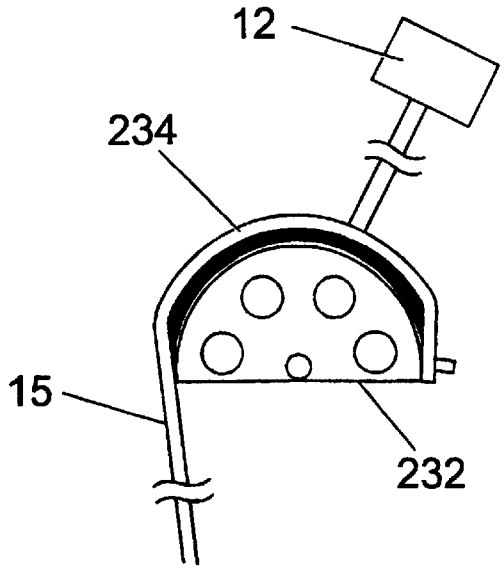
Figure 23C:
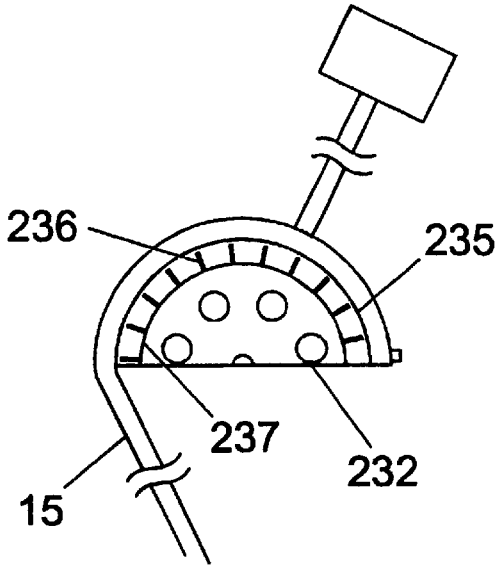
Figure 24A:
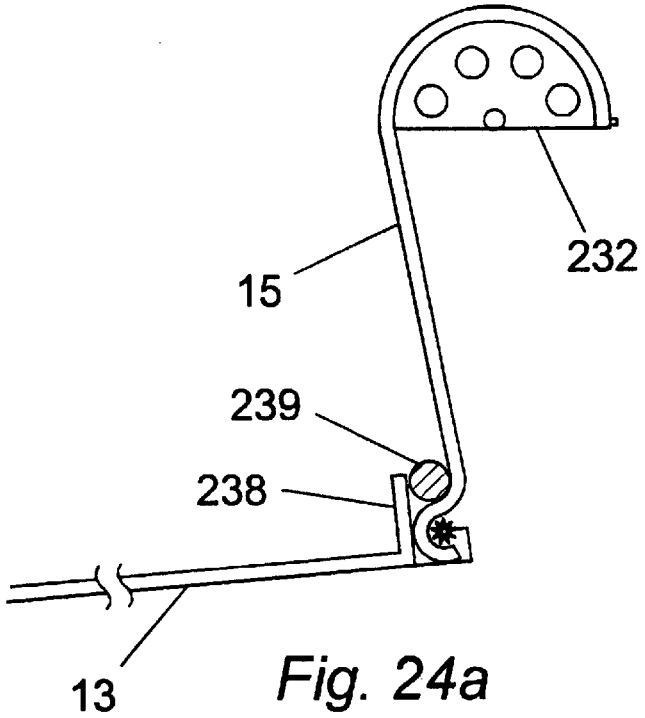
Figure 24B:
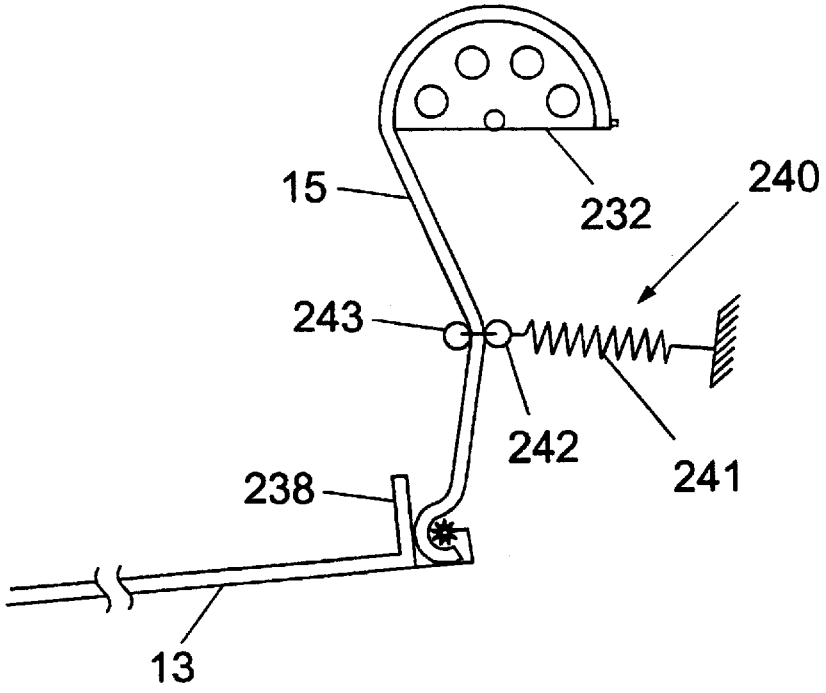
Figure 24C:
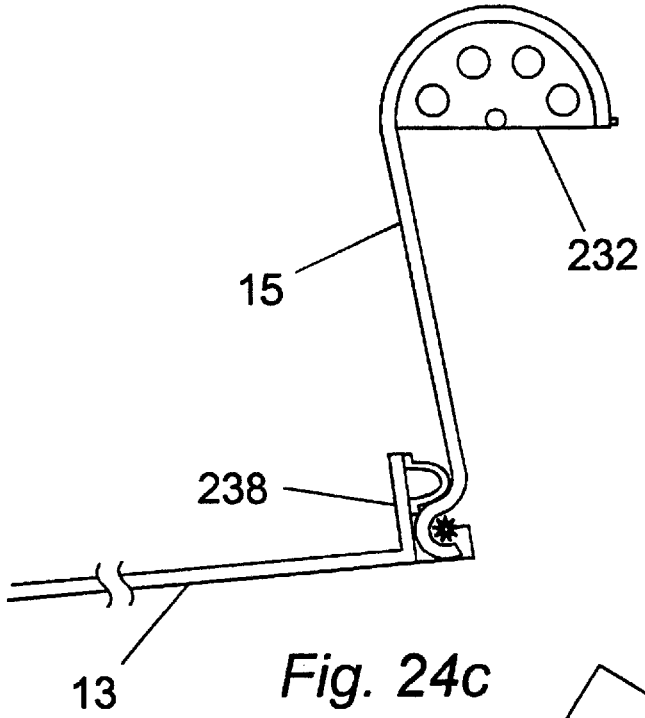
Figure 25:
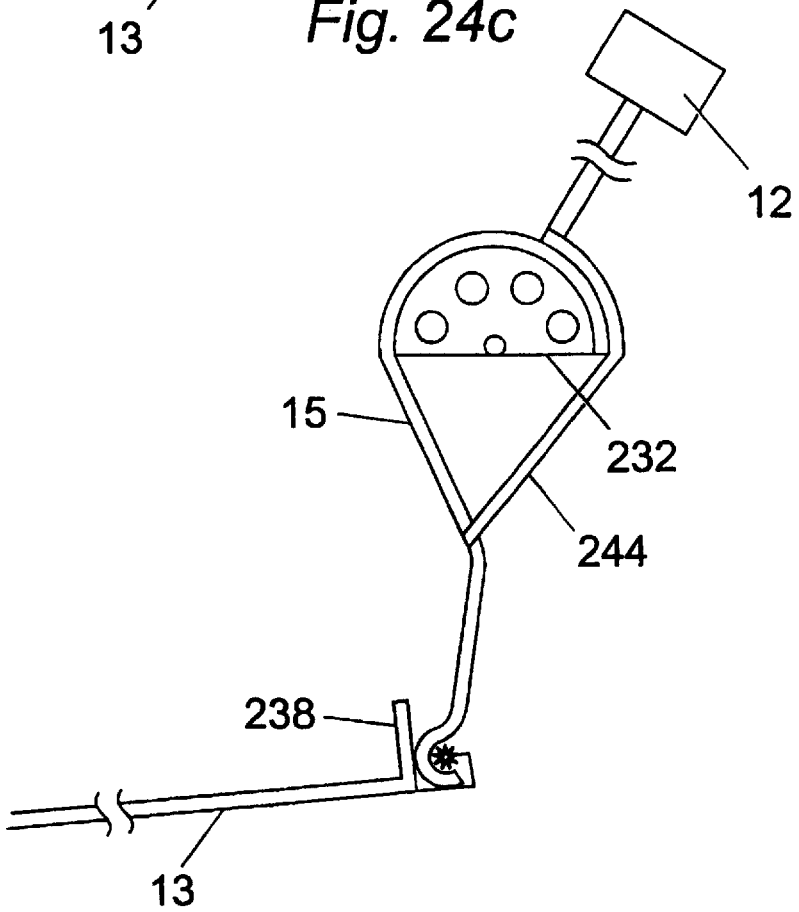
Figure 26:
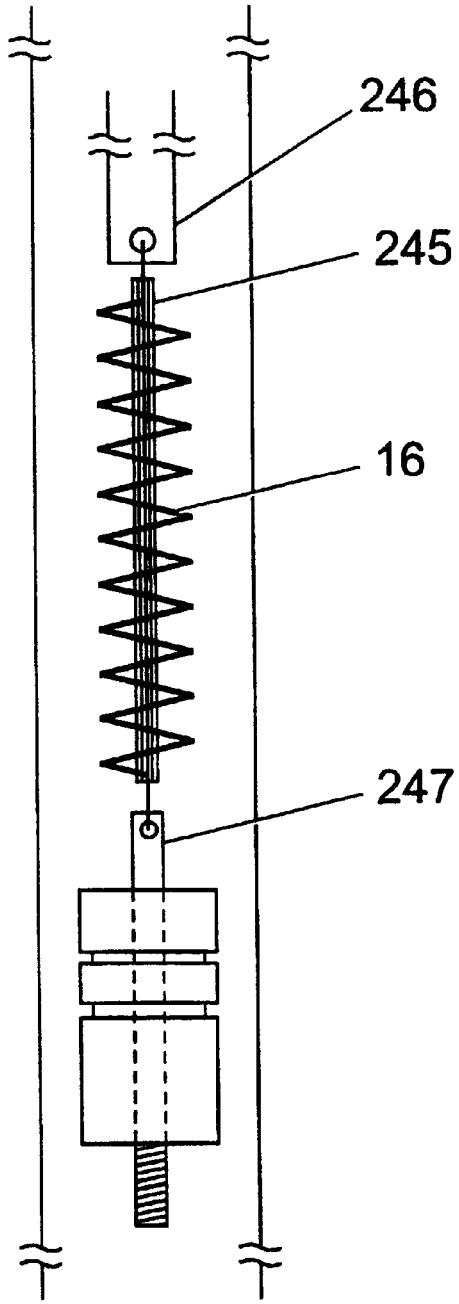
Figure 27A:
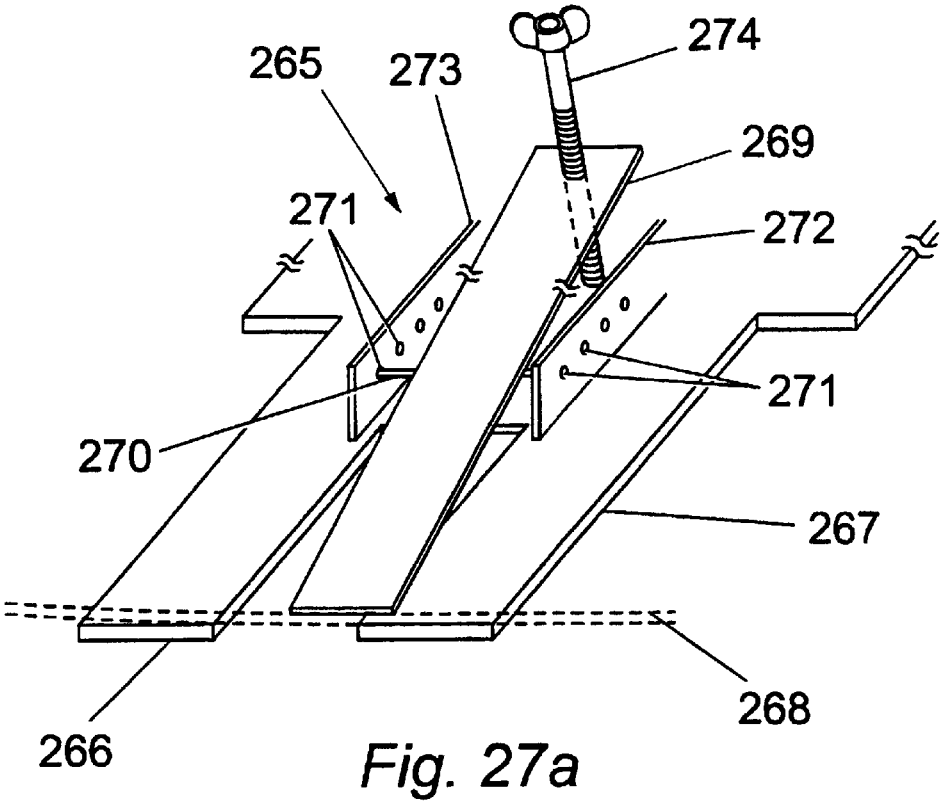
Figure 27B:
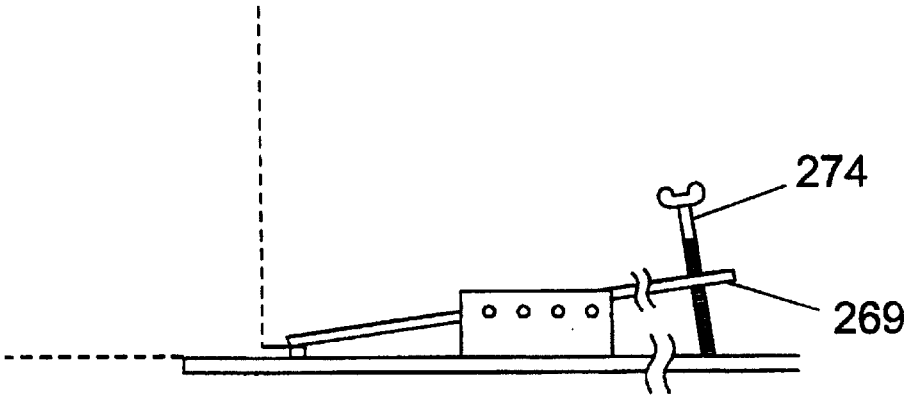

FIG. 7 is a schematic plan view showing inclined beater shafts;

FIG. 8 is a schematic plan view showing a beater pedal arrangement with a split foot plate;

FIG. 9 is a schematic front view of the arrangement of FIG. 8;

FIG. 10 is a side view showing a clamping arrangement;

FIG. 11 is a simplified side view of a portion of a disactivating arrangement;

FIG. 12 is a side view of an alternative disactivating arrangrment;

FIGS. 13A to FIG. 13E are side views of a catch mechanism;

FIG. 14 is a side view of a catch mechanism incorporated in a beater pedal arrangement;

FIG. 15*a* is a plan view of an alternative catch arrangement;

FIG. 15*b* is a front view of the FIG. 15*a* arrangement;

FIG. 16A is a plan view of a further catch arrangement in a first configuration;

FIG. 16B is a plan view of the catch arrangement of FIG. 16A in a second configuration;

FIG. 17A is a side view of a portion of the arrangement of FIG. 16A;

FIG. 17B is a side view of a portion of the arrangement of FIG. 16B;

FIG. 18 is a schematic side view of a portion of a disactivating means;

FIG. 19 is a side view of an alternative disactivating mechanism;

FIG. 20 is a schematic plan view of a portion of another disactivating means;

FIG. 21 is a side view of an alternative beater pedal arrangement;

FIG. 22 is a front view of a yet further beater pedal arrangement;

FIGS. 23A to 23C are side view of second beater shock-absorbing means;

FIGS. 24A to 24C are side views of alternative second beater shock-absorbing means;

FIG. 25 is a side view of a further alternative of a second beater shock-absorbing means;

FIG. 26 is a side view of a yet further alternative of a second beater shock-absorbing means;

FIG. 27A is a perspective view of an adjustable clamp for a beater pedal arrangement; and FIG. 27B is a side view of the adjustable clamp of FIG. 27A.

Various parts have been removed for clarity in each of the Figures.

The beater pedal arrangement shown in FIG. 1, FIG. 2 and FIG. 3 has a first beater 11 and a second beater 12 playable by means of a footplate or play pedal 13. A first belt 14 is wrapped in a first direction about a portion of the first beater 11 at one end and connected at its other end to the play pedal 13 and a second belt 15 is wrapped in a second direction around a portion of the second beater 12 at one end and attached at its other end to the play pedal 13. Pressing the play pedal 13 downwardly causes the first beater 11 to advance (ie move clockwise as shown in FIG. 1 and FIG. 2) and causes the second beater 12 to retract (ie to move anticlockwise as shown in FIG. 1 and FIG. 2) with respect to a striking surface 20 which will typically be a drum skin. Each of the beaters 11,12 move along a respective striking arc between their retracted and their striking positions.

Each of the beaters 11,12 is mounted for independent rotation about a shaft 21. Each beater has an associated pivot arm 18,19 and resilient means in the form of return springs 16,17. The return springs 16,17 bias the play pedal 13 to pivot upwardly once it has been depressed. This causes the second beater 12 to advance and strike the striking surface 20 and the first beater 11 to retract away from the striking surface 20. In this way, when the user depresses the play pedal 13 the first beater 11 advances to strike the beating surface 20 whilst the second beater 12 retreats and when the user releases the play pedal 13 the return springs 16,17 cause the second beater 12 to advance to strike the striking surface 20 and causes the first beater 11 to retract.

The arrangement also comprises disactivating means, operable by the user, to disactivate the second beater 12. The disactivating means comprises a heel activated switch pedal 22, a latch box 23 a latch 24 and a rack 25 and pinion 26 mechanism associated with the second beater 12. Depressing the switch pedal 22 from the configuration shown in FIG. 1 causes the rack 25 connected by means of a pivot 27 to the switch pedal 22 to advance upwardly. This rotates the second beater 12 by means of pinion 26 such that the second beater 12 is held rearwardly at a position along its striking arc at which it is inoperative. This movement also causes the latch 24 to engage in the latch box 23 to retain the second beater 12 in this position. This is illustrated in FIG. 2.

The length of the belts 14,15 is such that when the second beater 12 is held in its inoperative position the first beater 11 can continue to be played using the play pedal 13.

A further depression of the switch pedal 22 causes the latch 24 to disengage from the latch box 23; this releases the second beater 12 from its inoperative position allowing it to be used as before.

In this and all other embodiments of the present invention disclosed herein, the beater pedal arrangements preferably include belts 14 and 15 for driving the first and second beaters 11 and 12, respectively. In the particularly preferred embodiments of all of the examples of the invention, the first belt 14 is preferably "stiff" (i.e. relatively inelastic) along its length, whilst the second belt is preferably relatively resilient and elastic along its length. The reasons for this, and other variations for achieving the same results, are discussed in detail below.

The stiff belt 14 is most preferably a timing belt such as is known in the art. The use of a timing belt 14 provides a good response for the first beater 11 when the user depresses the play pedal 13. However, if a timing belt 15 is used for the second beater 12, there is a tendency for the second beater 12 to cause a double striking of the first beater 11 on the striking surface 20 (such as that shown in FIG. 1 and FIG. 2). The reason for this is that the use of a non-elastic material (such as that used in the manufacture of timing belts) for the belt 15 causes an over-extension of the second beater 12 after the first beater 11 has struck the striking surface 20. The second beater 12 reaches a point of maximum over-extension resulting from the depression of the play pedal 13, before returning along an arc in a clockwise direction (referring to FIG. 1 and FIG. 2) towards the striking surface 20. This return of the second beater 12 after over-extension causes a reactionary effect in the first beater 11 causing it to move in an arc away from the striking surface 20, thereby resulting in a small second striking of the first beater 11 on the striking surface 20 when the beater 11 returns to the surface 20. This is due mainly to the fact that the non-elastic timing belt is not able to cushion the over-extension of the second beater 12 and that the slack in the timing belt 15 is not taken up during over-extension.

The use of an elastic material such as a rubber strap for the belt 15 helps to reduce this effect. This is because when the play pedal 13 is depressed, causing the first beater 11 to strike the striking surface 20 and the second beater 12 to travel away from the striking surface 20, the elastic belt 15 becomes extended. Thus when the first beater 11 strikes the striking surface 20 and the second beater 12 becomes over-extended, the over-extension of the second beater 12 acts to reduce the tension in the extended strap 15. When the second beater 12 returns on its arc towards the striking surface 20, the strap 15 becomes extended once more, slowing the second beater 12, thereby at least partially reducing the resulting force transmitted to the first beater 11 and hence the double striking of the first beater 11 on the striking surface 20.

In an alternative arrangement shown in FIG. 23A, the second beater pulley 232 is provided with cushion means 233 along a portion of its outer surface, located between the outer surface of the pulley 232 and the inner surface of belt 15, which in this embodiment is a timing belt 15. The cushion means 233 takes the form of a foam insert which cushions the belt 15 when it comes into contact with the pulley both when the user depresses the play pedal, and when the belt comes into contact after having over-extended after the first beater 11 has come into contact with the striking surface 20.

FIG. 23B shows a further alternative along the lines of FIG. 23A utilising a leaf spring 234 located along a portion of the outer surface of the pulley 232. The leaf spring 234 provides a "cushion" for the belt 15 in the same way as the cushion means 233 of FIG. 23A.

FIG. 23C shows a further alternative along the lines of FIGS. 23A and 23B wherein the outer surface 235 of the second beater pulley 232 is sprung with a series of springs 236 located between the outer surface 235 and an inner surface 237 of the second beater pulley 232. This provides the desired cushion for the belt 15.

In a further alternative arrangement shown in FIG. 24A, belt 15 passes over the second beater pulley 232 and is attached as shown in FIGS. 1 to 3 between the pulley 232 and the play pedal 13. In this embodiment, the belt 15 is a stiff belt, which is most preferably a timing belt such as is known in the art. As shown in FIG. 24A, the play pedal 13 has a toe-stop 238 at its end nearest the pulley 232. The belt 15 is provided with tensioning means 239. The tensioning means 239 takes up the slack in the belt 15 during operation, particularly during the over-extension of the second beater pedal 12 when the play pedal 13 is depressed. In this way, the tension in the belt exerted by the tensioning means acts to at least partially reduce the force exerted on the first beater 11 by the second beater 12 during the over-extension of the second beater 12. The tensioning means 239 is a shaped elastic insert which may take the form of a cylinder as shown in FIG. 24A. Alternatively, the tensioning means may take the form of a leaf spring attached to the toe-stop 238 of the play pedal 13 as shown in FIG. 24C.

FIG. 24B shows an alternative arrangement wherein a tensioning force is applied to the belt 15 in a similar way as described above with reference to FIG. 24A. As shown, there is provided a spring tensioning means shown generally at 240 which comprises a spring 241 attached at one end to a fixed part of the beater pedal arrangement and attached at the other end to a roller device which straddles the belt 15, allowing the belt to pass through the gap formed between the two rollers 242, 243 during depression of the play pedal 13. The tensioning means 240 applies a tension force to the belt 15 thereby reducing the force transmitted to the first beater 11.

In a further alternative shown in FIG. 25, a belt 15 which is attached to the second beater pulley 232 and the toe-stop 238 of the play pedal 13 is tensioned via a tension strap 244. The tension strap 244 is connected at one end to the second beater 12 and at the other end to the stiff belt 15. In this embodiment, the stiff belt 15 is a timing belt which is known in the art. The tension strap 244 may take the form of an elastic strip such as a rubber strap, a spring, a leaf spring or any other suitable material. In this way, when the play pedal 13 is depressed and the second beater 12 rotates in an anti-clockwise direction, (viewing FIG. 25) the tension strap 244 maintains the tension in the belt 15 when the second beater 12 over-extends, thereby at least partially reducing the resulting force transmitted to the first beater 11 and hence the double striking of the first beater 11 on the striking surface 20.

In a further alternative shown in FIG. 26, the return spring 16 (such as spring 16 shown in FIG. 3) is provided with support means 245 which limits the over-extension of the second beater 12 after the first beater 11 has struck the striking surface 20 (such as that shown in FIG. 1 and FIG. 2). The support means 245 may take the form of an elastic strip or a suitable spring and is of a stiffness which either cushions the second beater 12 during over-extension or of a stiffness which effectively prevents the over-extension of the second beater 12. The support means 245 in this embodiment is a stiff elastic strip which passes through the central cavity in the return spring 16, the support means 245 being located between the same supports 246, 247 as the spring 16 shown. The support means 245 is adapted to provide a restraining force upon the second beater 12 at the maximum extension of the return spring 16 during the motion of the second beater 12 away from the striking surface 20. The second beater 12 is restrained up to this point by the return spring 16. The arrangement of this embodiment may be used to "cushion" the second beater 12 during over-extension, or may be used in combination with any other arrangement disclosed herein.

In yet a further alternative (not shown), there is provided a beater stop for the second beater 12 comprising a retaining means which forms part of the beater pedal arrangement. The retaining means may include a shaped retaining plate having a padded foam material designed to cushion the second beater 12 during over-extension of the beater 12.

The use of an elastic belt 15 and of the various cushioning and belt tensioning arrangements as described above effectively provide shock absorbing means associated with the second beater and serve to prevent or mitigate double-striking by the first beater as a result of the recoil or whiplash effect induced by movement of the second beater as described previously. It will be understood that the use of the cushioning and/or tensioning arrangements of FIGS. 23 to 26 allow a relatively inelastic belt to be used to drive the second beater (i.e. a belt similar to the belt used to drive the first beater). However, it will also be understood that combinations of an elastic belt, cushioning elements and belt tensioning arrangements may be employed to achieve the same result. The use of an elastic belt on its own is the preferred alternative, being the simplest and least expensive solution to the problem. It will also be understood that an elastic belt could be employed for driving the first beater. However, an inelastic belt will generally be desirable for most users of the device.

FIG. 4 shows an arrangement 41 in which resilient means in the form of a first return spring 44 and a second return spring 45 act on a plate 42 associated with one of the beaters 48 so as to rotate about pivot 43. Each of the return springs 44,45 is fixed to a frame of the pedal arrangement 46,47. The return springs 44,45 act on opposing sides of the plate 42 with respect to the pivot 43 such that they bias the beater 48 to a neutral position.

The arrangement 51 shown in FIG. 5A is similar to that of FIG. 4. In this case, the return springs 44,45 are connected to opposite ends of an arm 52 connected to beater 48 to rotate about a pivot point 43. In this case, the return springs are connected to a single attachment point 53 on a frame of the beater pedal arrangement; the attachment 53 may be positioned below the pivot point 43.

FIG. 5B shows an alternative arrangement of the return springs to that shown in FIG. 4 and FIG. 5A wherein the return springs for the first and second beaters 11 and 12 are located with their longitudinal axes displaced at an angle from the vertical. As shown in FIG. 5B, the second beater 12 and the first beater 11 may have springs 248 and 249 respectively attached at one end to pivot arms 250 and 251 respectively and at the other end to a frame of the beater pedal arrangement. The beaters 12 and 11 pivot about shafts 252 and 253 which have pivot arms 250 and 251 attached thereto by suitable means such as a fixing nut. In this way, the return springs 248 and 249 are arranged to provide tensile return forces on the beaters 12 and 11 respectively when the first beater 11 rotates towards a striking surface 20 (such as shown in FIG. 1 and FIG. 2) in the direction indicated by the arrow 254 and when the second beater 12 rotates away from the striking surface 20 in a direction indicated by the arrow 255, during depression of the play pedal 13.

FIG. 5C shows another alternative arrangement wherein the return springs 248 and 249 are arranged to provide compressive return forces on the beaters 12 and 11 respectively. It will be appreciated that the return spring arrangement may comprise a combination of both tensile and compressive return force springs acting on each beater or a tensile force spring on one beater and a compressive force spring on the other beater.

FIG. 5D shows a further alternative arrangement for the return spring on a beater, such as the second beater 12 shown. In this embodiment, the return spring 248 is attached at one end to the pivot arm 250, which pivots about the shaft 252, and at the other end to a spring tensioning mechanism 256. The mechanism 256 is located through a retaining member 257, which has a slot cut therethrough passing along the longitudinal axis of the retaining member 257. The mechanism 256 comprises a threaded retaining bolt 258 (which has a hole in its upper end for locating the spring 248) and two retaining nuts 259 for fixing the mechanism 256 to the retaining member 257. The bolt 258 passes through the slot in the member 257, the position of the bolt 258 and the tensile force which it exerts upon the spring 248 being governed by the retaining nuts 259. In this way, the tensile force exerted upon the spring and therefore the return tensile force exerted upon the second beater 12 may be adjusted by altering the position of the tensioning mechanism 256 as desired.

It will be appreciated that in all of the embodiments of FIGS. 5A to 5D, the dimensions and other parameters of the return springs may be varied as necessary to produce the desired forces upon the beaters 11 and 12.

The arrangement 60 illustrated in schematic plan view in FIG. 6 shows a first beater 61 and a second beater 62 arranged to move in a striking arc about respective axes of rotation 63,64. The axes of rotation 63,64 are inclined such that each of the beaters can strike a striking surface 65 at substantially the same point 66.

FIG. 7 shows a simplified plan view of a beater pedal having inclined first and second beater shafts 71, 72 arranged in a similar configuration to that of FIG. 6 such that each of the beaters (not shown) can strike a striking surface (for example a drum skin) at substantially the same point.

The arrangement 81 of FIG. 8 shows a beater pedal arrangement in which the footboard is split into left hand 82 and right hand 83 portions. Each portion 82,83 of the footplate operates a respective beater (not shown). The footplate portions may be depressed independently or together.

FIG. 9 shows a schematic front view of the arrangement of FIG. 8 in which the right hand portion of the footplate 83 is partially depressed to move the right hand beater (not shown) on shaft 84 by means of a belt (not shown).

FIG. 10 shows a beater pedal arrangement having an adjustable clamp 101. The clamp 101 is adapted to secure the beater arrangement to a flange of a drum 102 in which a drum skin 103 is mounted. The height of the clamp 101 from the base 104 of the beater arrangement is variable by adjustment means 105. This facilitates alignment of the height of the beater arrangement with the drum, for example, to ensure that the beater hits the drum skin in its sweet spot. A clamping arrangement 106 is used to secure the beater arrangement to the drum flange 102. One or more spacers or blocks which may be variable in height may be arranged underneath the drum to achieve a desired positioning height between the drum and the beater arrangement.

In an alternative arrangement (not shown) the beater arrangement has a plurality of fixed clamps arranged at different heights so that the drum may be clamped to one of the fixed clamps at a desired height.

FIG. 11 shows a free wheel mechanism that may be used as part of the disengaging means. The mechanism is adapted to disengage a beater 112 and to hold it along its striking arc at an inoperative position. The mechanism comprises an activating member 113 which is freely rotatable upon the shaft 114 about which beater 112 rotates when in use. The beater incorporates a stop 115 spaced from the beater shaft which, when the beater rotates clockwise and anti-clockwise in normal use is free to travel in a recess 116 of member 113. The stop may be provided on a plate which cooperates with the beater. The member 113 is rotatable clockwise (as shown in FIG. 11) by means of a disactivating means (not shown) which may be in the form of a footpedal which may be activated by the user so that a contacting portion 117 of the recess 116 co-operates with the stop 115 to move the beater 112 rearwardly (ie. clockwise as shown in FIG. 11). In this position, the beater 112 may be disactivated so that it does not move forward under the action of the footplate (not shown) until it is released from its disengaged position.

FIG. 12 shows a similar disactivating means in which member 123 is rotatable about the axis 124 of beater 122. The member 123 has a fixed stop 125 which co-operates with the beater shaft to move the beater 122 rearwardly (clockwise as shown) when the member 123 is rotated clockwise by a disactivating means provided in this case by a pedal 126 and lever 127 mechanism operable by the user.

FIG. 13A to FIG. 13E illustrates one form of disactivating means that may be used to disactivate one of the beaters of the beater pedal arrangement. The purpose of the device is to allow a push/push action of a disactivating pedal operable by the drum user to rotate a top arm which is connected via a lost motion quadrant to a hexagonal shaft which drives the drum beater. The top arm is spring loaded to rotate in the clockwise direction (as shown).

Figures 13A, 13B, 13C, 13D, 13E:
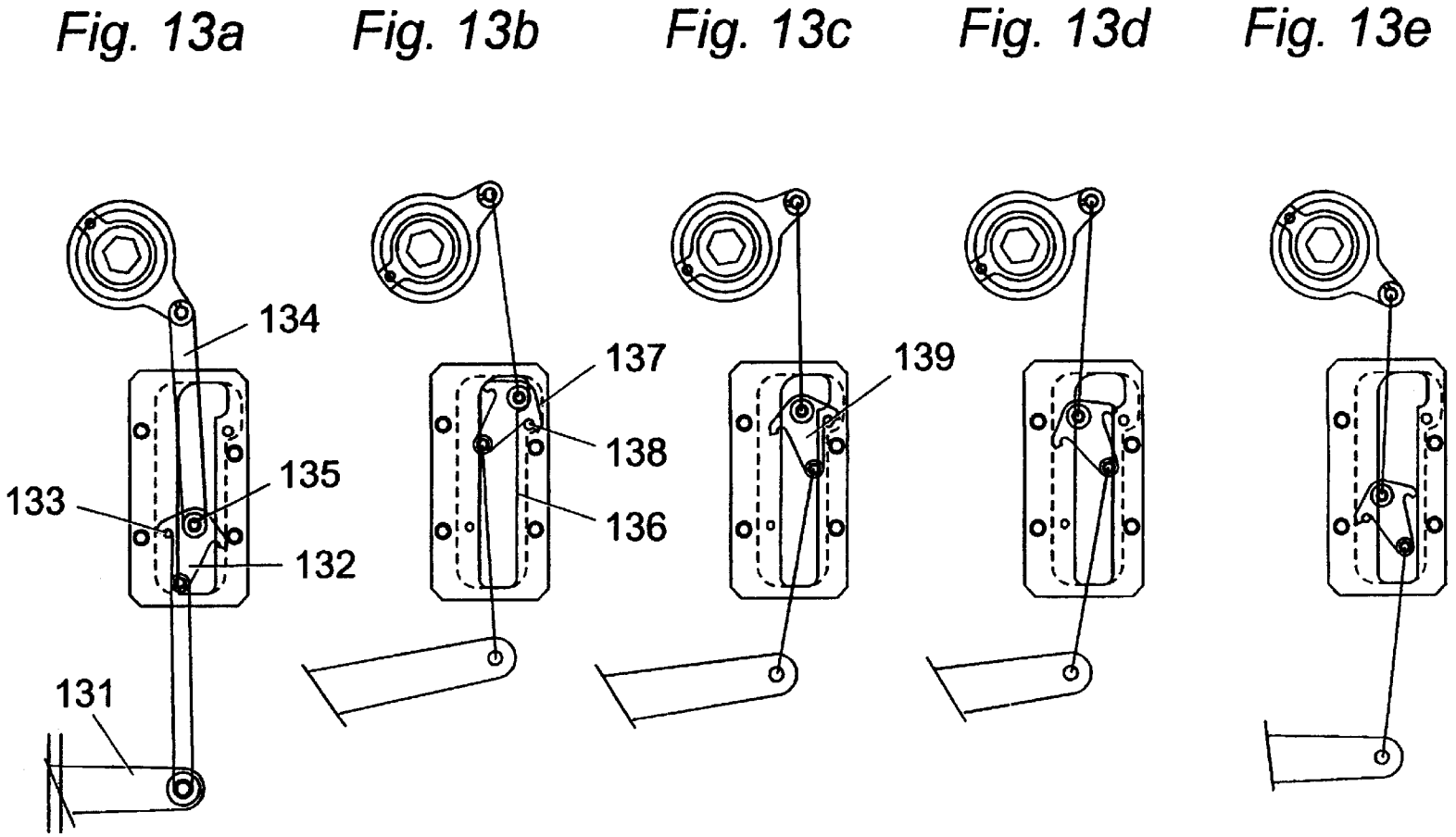

FIG. 13A shows the mechanism with the bottom lever 131 in a low position and an anchor member 132 hanging from a lower pin 133. The force from the upper arm 134 via a top link 135 tends to rotate the anchor 132 clockwise.

In FIG. 13B the bottom lever is raised (by the user pressing down on the other end of this lever); this pushes the anchor 132 up slot 136 until its right hand portion 137 hooks round and over a top pin 138. This action rotates the top arm 134 against the spring action. The line of action from the top arm 134 via the top link 135 is slightly to the left of the top pin 138. Hence, when the force from the bottom lever 131 is removed the anchor 132 rotates to the position shown in FIG. 13C. In this position, the anchor 132 is hanging on the top pin 138 with its tail 139 bearing against the running slot. in this position the top arm is held in a stable "parked" position. When the bottom lever 131 is raised again, as illustrated in FIG. 13D, with the line of action of the forces tending to rotate the anchor 132 now anticlockwise, the anchor unhooks itself from the top pin 138. When the force from the bottom lever 131 is removed, as shown in FIG. 13E, the anchor 132 is free to run down the slot 136 to hook onto the lower pin 133 to resume the configuration illustrated in FIG. 13A.

FIG. 14 shows a side view of the mechanism illustrated in FIG. 13A to FIG. 13E incorporated in a beater pedal arrangement. The lower arm 131 is pivoted at 141 and is operable by the user using his or her foot to disactivate at least one of the drum beaters.

FIG. 15 shows an alternative on/off mechanism for a disengaging means. This comprises a sprung foot operable lever 151 with a cooperating receiving catch 152. The lever 151 is connected to a disactivating means which disactivates at least one beater when it end 153 is depressed. The lever 151 is elastically deformable such that it can enter into catch 152 and be retained in its disactivating position. The lever may be released by being deformed so as to release it from catch 152. It may be released by means of the user activating and perhaps pushing down on a second cooperating lever.

In a similar arrangement (not illustrated) the catch 152 is moveable or resilient so as to be capable of catching and releasing the lever 151. In this case, the lever may be rigid.

FIGS. 16A, 16B and FIGS. 17A, 17B illustrate a preferred embodiment of a catch mechanism for a disactivating lever 161. in this case, a resiliently biased catch 162 is arranged to catch and retain the lever 161 when this is depressed to hold the disactivating means (not shown) in its disactivating position. In particular, FIG. 16A is a plan view of a catch mechanism shown generally at 223 in a first configuration, FIG. 16B is a plan view of the catch arrangement shown generally at 223 in a second configuration and FIGS. 17A and 17B are side views of portions of the arrangements of FIGS. 16A and 16B respectively.

Referring to FIG. 16A, the catch arrangement is shown in a first configuration wherein the first and second beaters 11 and 12 (not shown) of a beater arrangement such as that disclosed in FIG. 1 are both striking a striking surface 20 (not shown). In this first configuration, the disactivating lever 161 is in a first position wherein the catch 162 (which is housed in a shaped retainer 225 which has a passage therethrough for the location of the catch 162) lies with its end surface 225 adjacent to a surface 227 of the lever 161. The catch 162 is held adjacent to the lever 161 in this way via resilient biassing means 228, which in this embodiment comprises a compression spring 228 held between a portion 229 of the frame of the beater pedal arrangement and an adjustable ring retainer 230, which may be used to increase or decrease the compressive force applied to the spring 228.

When it is desired to disactivate one of the beaters 11, 12 of the beater arrangement, the user depresses the shaped plate portion 224 of the lever 161. The lever 161 pivots about the frame via pivot 231 such that the face 227 of the lever 161 pivots upwardly away from the face 226 of the catch 162. When the user has fully depressed the lever 161, the catch 162 passes beneath the lower edge of the lever 161, as shown in FIG. 17A, the catch being forced into this position via the compressive force acting on the catch 162 via the spring 228. In this way, the lever 161 is retained in this depressed state, and thus one of the beaters 11, 12 is disactivated.

Referring now to FIG. 16B, when it is desired to re-activate the disactivated beater, the user depresses the lever 165. The lever 165 pivots about hinge unit 275 in the direction indicated by arrow 276. This in turn applies to a force upon the catch 162 in the direction indicated by arrow 277, acting against the compression spring 228. When the catch 162 has been withdrawn from beneath the lever 161, the lever 161 returns to a position shown in FIG. 16A, thereby re-activating the disactivated beater via the disactivating means (not shown). In the preferred embodiment of the present invention, the disactivating means comprises an arrangement as described above with reference to FIG. 11 and/or FIG. 12. It will be appreciated that the lever 126 of FIG. 12 may be the disactivating lever 161 of FIGS. 16A and 16B.

The disactivating lever 161 may be released from its caught position by moving the catch 162 against its resilience means 164. This may be done by means of a second lever 165. The second lever 165 may be arranged to rotate about an axis substantially perpendicular to the axis of the resiliently biased catch 162 so as to move the catch 162 rearwardly. This direction of rotation is illustrated by arrow 166 in FIG. 17. In a further arrangement (not shown) the mechanism may have a plate arranged to be moved along the axis of the resilient bias of the catch 162 so as to release the lever 161. This may be moveable by the user using his or her foot to release lever 161.

FIG. 18 shows a disactivating linkage 181 operable by disactivating pedal 182. Linkage 181 is inclined with respect to a frame 183 of the beater pedal arrangement to which it is resiliently connected at 184. Raising member 181 causes it to cooperate with a portion 185 of beater 186 to hold the beater 186 in a disactivated position.

Any linkage used in the disactivating means to move a beater to a disactivated position may include a resilient means to allow some waggle of the beater.

FIG. 19 shows a disactivating linkage 191 comprising linkages 192,193 and 194 pivoted together at 195 and 196. Linkage 192 is rotatable about pivot 197 and linkage 193 is rotatable about pivot 198 to disactivate a beater pedal 199 by moving it to an inoperative position.

FIG. 20 shows a disactivating means comprising a wrap spring 2001 arranged around a rotatable shaft 202 which moves with a beater 203. When actuated, the wrap spring 201 tightens on the shaft 202 to prevent motion in one direction. Preferably, the wrap spring is arranged such that when activated the beater 203 can move to a disactivated position but is prevented from moving forwards to strike a striking surface.

FIG. 21 shows a beater arrangement in which a pair of beaters 212 and 213 are arranged on a single beater shaft 214 in substantially diametrically opposed positions. As beater 212 is advanced (anticlockwise as shown) to strike a striking surface (not shown) beater 213 is moved rearwardly (again anticlockwise) away from the striking surface. Similarly, when beater 213 moves forward to strike the striking surface beater 212 moves rearwardly. The beaters may be arranged to the side of the beater pedal 215 (not illustrated) so that they do not foul with the pedal or the player's foot.

FIG. 22 shows an arrangement similar to that of FIG. 21 in which each of a pair of beater shafts 221 222 have a pair of beaters attached thereto.

The support towers 260 in FIG. 21 and FIG. 22 may be of a height h which enables the beaters 212 and 213 of FIG. 21 and the beaters 212, 213, 261 and 262 of FIG. 22 to strike the striking surface (not shown) as near to the centre of the striking surface as possible. Furthermore, the lengths of the beaters 212 and 213 of FIG. 21 and the beaters 212, 213, 261 and 262 of FIG. 2 (measured from the beater shafts 214 and 221, 222 respectively) may be adjustable for the same purpose. The lengths of the beaters 212, 213, 261 and 262 may be adjustable by adjusting means such as telescopic beater support shafts 263 and 264 as shown or any other suitable adjusting means.

It will also be appreciated that an arrangement (not shown) consisting of a first beater such as the beater 11 of FIG. 1, and a second and third beater such as 212, 213 of FIG. 21 may be provided by combining features of the embodiments of FIG. 1 and FIG. 21.

FIGS. 27A and 27B illustrate an adjustable clamp for a beater pedal arrangement shown generally at 265. Two shaped feet 266 and 267 extend from a beater pedal arrangement in a known way, however, the feet 266 and 267 are longer than are known in the art. The feet 266 and 267 co-operate with, for example, the rim of a drum so as to provide support for the drum itself, the rim of the drum resting upon feet 266 and 267 as indicated by the dotted line 268. The retaining plate 269 has a pivot shaft 270 passing therethrough, the pivot shaft 270 being adapted to co-operate with a series of pairs of holes or slots 271 in the upright support plates 272 and 273. In this way, the retaining plate/pivot shaft arrangement 269/270 may be moved to pivot about any of the corresponding opposing pairs of holes or slots 271 in the upright supports 272 and 273. An end of the retaining plate 269 is provided with support means such as a threaded bolt 274 adapted to provide a down force upon the opposing end of the plate 269 when the bolt 274 is turned in a clockwise direction. In this way, the adjustable clamp 265 is adapted to grasp and retain the rim of a drum in a variety of positions by altering the positioning of the retaining plate/pivot shaft arrangement 269/270 with respect to the holes 271. In this way, a beater pedal arrangement comprising the adjustable clamp of FIG. 27 may be located at a desired distance from the striking surface of a drum.

Improvements and modifications may be incorporated without departing from the scope of the invention as defined in the claims appended hereto.

What is claimed is:

1. A beater pedal arrangement comprising a first and a second beater each arranged to follow a respective striking arc towards and away from a forward (striking) position, in which the arrangement is also provided with a heel engaged disactivating means operable by a user while playing a drum to prevent at least one of the beaters from striking;

wherein the beaters are operable by means of a single, common beater pedal and are arranged such that:

a) upon the beater pedal being moved in a first direction, the first beater is moved along its striking arc towards said forward position while the second beater is moved along its striking arc away from said forward position; and b) upon the beater pedal being moved in a second direction, the second beater is moved along its striking arc towards said forward position while the first beater is moved along its striking arc away from said forward position;

and wherein:

said disactivating means is operable to prevent at least one of the beaters from striking by retaining that beater at a rearward position along its striking arc by being pressed downwardly in a substantially vertical direction and wherein:

the disactivating means is engaged by pressing a first lever.

2. A beater pedal arrangement in accordance with claim 1 wherein each beater is arranged to impact a drum skin of a bass drum when it follows its striking arc and wherein the beaters are arranged to impact the same drum skin.

3. A beater pedal arrangement in accordance with claim 2 wherein the disactivating means comprises hydraulically operated disactivating means.

4. A beater pedal arrangement in accordance with claim 1 wherein each beater is moved by the beater pedal by drive means comprising a belt.

5. A beater pedal arrangement in accordance with claim 1 wherein at least one of the beaters has a spring return and wherein at least one of the beaters is movable towards a first position by means of its spring return.

6. A beater pedal arrangement in accordance with claim 1 wherein the second beater is provided with shock absorbing means for preventing double striking by the first beater.

7. A beater pedal arrangement in accordance with claim 6 wherein the shock absorbing means comprises a second beater drive means, and wherein the second beater drive means comprises a belt of elastic, resilient material.

8. A bearer pedal arrangement in accordance with claim 6 wherein the second beater drive means comprises a belt and the shock absorbing means includes means for at least one of tensioning and cushioning said belt.

9. A beater pedal arrangement in accordance with claim 8 wherein the means for at least one of tensioning and cushioning said belt includes a deformable foam insert located between a drive pulley of the second beater and the second beater drive means.

10. A beater pedal arrangement in accordance with claim 8 wherein the means for at least one of tensioning and cushioning said belt includes one of a deformable insert and a leaf spring located between a portion of the beater pedal and the second beater drive means.

11. A beater pedal arrangement in accordance with claim 8 wherein the tensioning means takes the form of one of a spring and roller device, an elastic belt attached to the second beater and an elastic strap attached to the second beater, for providing a tensioning force on the second beater drive means.

12. A beater pedal arrangement in accordance with claim 8 wherein the means for at least one of tensioning and cushioning said belt includes a leaf spring located between a drive pulley of the second beater and the second beater drive means.

13. A beater pedal arrangement in accordance with claim 8 wherein the means for at least one of tensioning and cushioning said belt includes a spring cushioned surface located between a drive pulley of the second beater and the second beater drive means.

14. A beater pedal arrangement in accordance with claim 1 wherein the disactivating means comprises electrically operated disactivating means.

15. A beater pedal arrangement in accordance with claim 1 wherein the disactivating means is disengageable by the user whilst playing the drum using the beater arrangement and where the disactivating means is heel disengaged by being pressed downwardly.

16. A beater pedal arrangement in accordance with claim 1 wherein the disactivating means is disengaged by pressing a second lever.

17. A beater pedal arrangement in accordance with claim 1 wherein the disactivating means comprises a single lever and wherein the disactivating means is engaged and disengaged by the user via the single lever.

18. A beater pedal arrangement in accordance with claim 17 wherein the disactivating means further comprises a catch for retaining the lever and wherein the lever is engaged and disengaged by the catch.

19. A beater pedal arrangement in accordance with claim 18 wherein the lever is engaged by the catch by pushing the lever in a first direction and wherein the lever is disengaged by the catch by pushing the catch in a second direction.

20. A beater pedal arrangement in accordance with claim 1 wherein each beater is moved by the beater pedal by drive means comprising a cord.

21. A beater pedal arrangement in accordance with claim 1 wherein each beater is moved by the beater pedal by drive means comprising a chain.

22. A beater pedal arrangement in accordance with claim 1 wherein each beater is moved by the beater pedal by drive means comprising a gear.

23. A beater pedal arrangement in accordance with claim 1 wherein each beater is moved by the beater pedal by drive means comprising a linkage.

24. A beater pedal arrangement in accordance with claim 1 wherein the disactivating means comprises mechanically operated disactivating means.

25. A beater pedal arrangement in accordance with claim 1 wherein the disactivating means comprises mechanically operated disactivating means.

26. A beater pedal arrangement comprising a first and a second beater each arranged to follow a respective striking arc towards and away from a forward (striking) position, in which the arrangement is also provided with a heel engaged disactivating means operable by a user whilst playing a drum to prevent at least one of the beaters from striking wherein the beaters are operable by means of a single, common beater pedal and are arranged such that:

a upon the beater pedal being moved in a first direction, the first beater is moved along its striking arc towards said forward position whilst the second beater is moved along its striking arc away from said forward position; and b upon the beater pedal being moved in a second direction, the second beater is moved along its striking arc towards said forward position whilst the first beater is moved along its striking arc away from said forward position: wherein:

each of the beaters has a spring return such that the first beater is moved away from said forward position by means of its spring return and the second beater is moved towards said forward position by means of its spring return and wherein:

the second beater is provided with shock absorbing means for preventing double striking by the first beater.

27. A beater pedal arrangement in accordance with claim 26 wherein the shock absorbing means comprises a second beater drive means, and wherein the second beater drive means comprises a belt of elastic, resilient material.

28. A beater pedal arrangement in accordance with claim 26 including a second beater drive means and wherein the second beater drive means comprises a belt and the shock absorbing means includes means for at least one of tensioning and cushioning said belt.

29. A beater pedal arrangement in accordance with claim 28 wherein the means for at least one of tensioning and cushioning said belt includes a deformable foam insert located between a drive pulley of the second beater and the second beater drive means.

30. A beater pedal arrangement in accordance with claim 28 wherein the means for at least one of tensioning and cushioning said belt includes a spring located between a drive pulley of the second beater and the second beater drive means.

31. A beater pedal arrangement in accordance with claim 28 wherein the means for at least one of tensioning and cushioning said belt includes a spring cushioned surface located between a drive pulley of the second beater and the second beater drive means.

32. A beater pedal arrangement in accordance with claim 28 wherein the means for at least one of tensioning and cushioning said belt includes at least one of a deformable insert and a leaf spring located between a portion of the beater pedal and the second beater drive means.

33. A beater pedal arrangement in accordance with claim 28 wherein the tensioning means takes the form of one of a spring and roller device, an elastic belt attached to the second beater and an elastic strap attached to the second beater, for providing a tensioning force on the second beater drive means.

34. A beater pedal arrangement comprising at least one beater arranged to follow a striking arc in which the arrangement has opposing first and second resilient means which together act to bias the beater towards a neutral position along its striking arc.

35. A beater pedal arrangement having a first beater arranged to follow a first striking arc in a first plane about a first axis of rotation and a second beater arranged to follow a second striking arc in a second plane about a second axis of rotation in which the first and second axes of rotation are inclined such that said first and second planes of said first and second striking arcs converge in a forward striking direction.

36. A beater pedal arrangement comprising a first and a second beater rotatable about a common axis of rotation in which the first beater strikes a striking surface by means of rotating in a first direction about the axis and the second beater strikes a striking surface by means of rotating in an opposite direction about the axis of rotation.

37. A beater pedal arrangement comprising a first and a second beater each arranged to follow a respective striking arc towards and away from a forward (striking) position, therein the beaters are operable by means of a beater pedal having a foot board which is split into a first, left hand portion and second, a right hand portion, the first portion of the foot board being arranged to play one of said first and second beaters and the second portion of the foot board being arranged to play the other of said first and second beaters, said first and second footplate portions being arranged adjacent one another such that they are adapted to be depressed either independently or together, the beaters being arranged such that:

a) upon said first and second footplate portions being moved together in a first direction, the first beater is moved along its striking arc towards said forward position while the second beater is moved along its striking arc away from said forward position; and b) upon said first and second footplate portions being moved together in a second direction, the second beater is moved along its striking arc towards said forward position while the first beater is moved along its striking arc away from said forward position; wherein:

each of the beaters has a spring return such that the first beater is moved away from said forward position by means of its spring return and the second beater is moved towards said forward position by means of its spring return; and wherein:

the second beater is provided with shock absorbing means for preventing double striking by the first beater.

38. A beater pedal arrangement comprising a first and second beater each arranged to follow a respective striking arc towards and away from a forward (striking)position, in which the arrangement is also provided with a heel engaged disactivating means operable by a user whilst playing a drum to prevent at least one of the beaters from striking;

wherein the beaters are operable by means of a single, common beater pedal and are arranged such that:

a) upon the beater pedal being moved in a first direction, the first beater is moved along its striking arc towards said forward position whilst the second beater is moved along its striking arc away from said forward position; and b) upon the beater pedal being moved in a second direction, the second beater is moved along its striking arc towards said forward position whilst the first beater is moved along its striking arc away from said forward position;

and wherein:

said disactivating means is operable to prevent at least one of the beaters from striking by retaining that beater at a rearward position along its striking arc by being pressed downwardly in a substantially vertical direction;

and wherein:

the tensioning means takes the form of one of a spring and roller device, an elastic belt attached to the second beater and an elastic strap attached to the second beater, for providing a tensioning force on the second beater drive means.

39. A beater pedal arrangement comprising a first and a second beater each arranged to follow a respective striking arc towards and away from a forward (striking) position, in which the arrangement is also provided with a heel engaged disactivating means operable by a user while playing a drum to prevent at least one of the beaters from striking;

wherein the beaters are operable by means of a single, common beater pedal and are arranged such that:

a) upon the beater pedal being moved in a first direction, the first beater is moved along its striking arc towards said forward position while the second beater is moved along its striking arc away from said forward position; and b) upon the beater pedal being moved in a second direction, the second beater is moved along its striking arc towards said forward position while the first beater is moved along its striking arc away from said position;

and wherein:

said disactivating means is operable to prevent at least one of the beaters from striking by retaining that beater at a rearward position along its striking arc by being pressed downwardly in a substantially vertical direction;

and wherein:

the disactivating means has a click on/off arrangement such that it is engaged by being depressed once and disengaged by being pressed once.

40. A beater pedal arrangement in accordance with claim 39 wherein the disactivating means is pressed in the same direction for both engaging and disengaging the disactivating means.

* * * * *